US005396026A

United States Patent [19]

Sato et al.

[11] Patent Number: 5,396,026

[45] Date of Patent: Mar. 7, 1995

[54] MAGNETIC BRUSH DEVELOPING APPARATUS

[75] Inventors: Kunihiko Sato; Sachio Sasaki; Akira Nagahara; Shin Araki, all of Kawasaki; Hideaki Iwasaki, Kashiwa; Kenji Fuke, Kawasaki; Futoshi Okabayashi; Takamasa Araki, both of Hyogo, all of Japan

[73] Assignee: Fujitsu Limited, Kawasaki, Japan

[21] Appl. No.: 127,594

[22] Filed: Sep. 28, 1993

Related U.S. Application Data

[63] Continuation-in-part of Ser. No. 47,065, Apr. 16, 1993, which is a continuation of Ser. No. 749,759, Aug. 26, 1991, abandoned.

[30] Foreign Application Priority Data

Sep. 3, 1990 [JP] Japan ..... 2-233906
Sep. 29, 1992 [JP] Japan ..... 4-259241

[51] Int. Cl.[6] ..... G03G 15/09
[52] U.S. Cl. ..... 118/658; 355/251
[58] Field of Search ..... 118/658, 657; 355/251

[56] References Cited

U.S. PATENT DOCUMENTS 4,492,456 1/1985 Haneda et al. .
4,825,241 4/1989 Saijo et al. .
4,844,008 7/1989 Sakemi et al. .
4,851,872 7/1989 Murasaki et al. .
4,911,100 3/1990 Yamashita ..... 118/658
4,960,070 10/1990 Nishimura .
5,044,313 9/1991 Yuge et al. ..... 118/658
5,051,782 9/1991 Yamaji ..... 355/251
5,072,690 12/1991 Ishikawa et al. ..... 118/658
5,212,344 5/1993 Kageyama et al. ..... 118/658

*Primary Examiner*—R. L. Moses
*Attorney, Agent, or Firm*—Nikaido, Marmelstein, Murray & Oram

[57] ABSTRACT

A magnetic brush developing apparatus, comprising: a development container (102) for containing a developer; a magnet (122) stationarily located in the development container and having magnetic poles radially provided on a plurality of points; a rotational sleeve (121) arranged to cover the outer circumference of the magnet and rotatably driven to carry the developer in the development container to an image carrying body (131); and a blade (123) arranged opposite to the sleeve to restrict the amount of the developer which is carried by the sleeve. Two of the magnetic poles are a developing magnetic pole (Pd) facing opposite to the image carrying body (131) and a developer transfer magnetic pole (Pt) located between the developing magnetic pole (Pd) and the blade (123). A magnetic brush of the developer formed on the sleeve (121) by the developer carrying magnetic pole (Pt) has a magnetic flux density. A width or angle of a region where a radial component of the magnetic flux density exceeds over a half of a maximum value thereof, i.e., a half value width, is determined in such a manner that the developer is prevented from flying away from the magnetic brush.

12 Claims, 26 Drawing Sheets

Fig. 8

| | | VARIATION RANGE OF MAGNETIC FLUX DENSITY | | | |
|---|---|---|---|---|---|
| | | ±25% OR MORE | ±20% OR LESS | ±15% OR LESS | ±10% OR LESS |
| RANGE FORM MAGNETIC DENSITY SECTION | ±2 DEGREES OR LESS | × | × | × | △ |
| | ±3 DEGREES OR MORE | × | △ | △ | ○ |
| | ±5 DEGREES OR MORE | × | △ | ○ | ○ |
| | ±10 DEGREES OR MORE | △ | ○ | ○ | ◎ |

LEGEND:

× POOR ..... GOOD RATIO OF APPARATUS OF 50% OR LESS

△ FAIR ..... GOOD RATIO OF APPARATUS OF 60% OR MORE

○ GOOD ..... GOOD RATIO OF APPARATUS OF 80% OR MORE

◎ EXCELLENT ..... GOOD RATIO OF APPARATUS OF APPROXIMATELY 100% IMAGE EVALUATION RESULTS

LEGEND:

| MAGNETIC POLE | POLE | STRENGTH OF MAGNETIZATION | WIDTH OF POLE | POSITION OF POLE |
|---|---|---|---|---|
| A | N | 1.8 (kG) | 60° | 0 |
| B | S | | 30° | 75° |
| C | N | | 25° | 167.5° |
| D | S | | 35° | 212.5° |
| E | S | | 40° | 300° |

LEGEND:

| MAGNETIC POLE | POLE | STRENGTH OF MAGNETIZATION | WIDTH OF POLE | POSITION OF POLE |
|---|---|---|---|---|
| A | N | 1.8 (kG) | 60° | 0° |
| B | S | 1.8 (kG) | 30° | 80° |
| C | N | 0.2 (kG) | 15° | 117.5° |
| C | N | 1.8 (kG) | 25° | 157.5° |
| D | S | 1.8 (kG) | 35° | 212.5° |
| E | N | 1.8 (kG) | 40° | 300° |

PRESENT INVENTION

Fig. 27

| ANGLE $\theta$ | NUMBER OF VOID LOCATIONS (NUMBER/A4, 10 SHEETS) |
|---|---|
| 23° | 21 |
| 24° | 10 |
| 26° | 3 |
| 28° | 1 |
| 29° | 0 |
| 30° | 0 |
| 31° | 0 |
| 32° | 0 |

Fig. 29

| ANGLE θ | NUMBER OF VOID LOCATIONS (NUMBER / A4 10 SHEETS) | CARRIER INSIDE UNIT |
|---|---|---|
| 23° | 138 | PRESENCE |
| 24° | 52 | PRESENCE |
| 26° | 18 | LITTLE PRESENCE |
| 28° | 3 | ABSENCE |
| 29° | 0 | ABSENCE |
| 30° | 0 | ABSENCE |
| 31° | 0 | ABSENCE |
| 32° | 0 | ABSENCE |

MAGNETIC BRUSH DEVELOPING APPARATUS

This application is a continuation-in-part application of U.S. patent application Ser. No. 08/047,065, filed on Apr. 16, 1993, which is a file-wrapper continuation application of U.S. patent application Ser. No. 07/749,759, filed on Aug. 26, 1991, which is now abandoned.

BACKGROUND OF THE INVENTION

1. Field of the Invention

The present invention relates to a magnetic brush developing apparatus for developing an electrostatic latent image, which is used in an electrophotographic recording apparatus or the like.

Widely known as a developing method applicable to a developing apparatus is a two-component magnetic brush developing method using a toner or a colored powder, and a carrier or a magnetic powder as a developer.

The carrier used therein imparts an electrostatic charge to the toner through a triboelectrification or the like thereof, and the toner is held by the electrostatic force for conveyance.

Also, the developing roller functions to convey the developer to the developing section and holds the carrier by the magnetic force for conveyance, and thus the magnetic properties of the developing roller have a great influence on the image quality.

2. Description of the Related Art

The principle of the two-component magnetic brush developing method relevant to the present invention, will now be described with reference to FIG. 18.

A developing roller 1 is constituted of a magnet 1*b* having a plurality of magnetic poles, and a rotational sleeve 1*a* which rotatably covers the surface of the magnet 1*b*.

The magnet 1*b* is usually fixed, and a developer 4 is caught on the surface of the rotational sleeve 1*a*, through the magnetic force exerted by the magnet 1*b*, and carried to a developing section 9 in which a photosensitive drum 3 confronts the developing roller 1*a*, through the rotation of the rotational sleeve 1*a*.

The developer restriction member 2, i.e., a blade is arranged opposite to the developing roller 1 (rotational sleeve 1*a*) to restrict the amount of the developer 4 to be carried to the developing section 9.

The amount of the developer 4 passing through the developer restriction member 2 is determined by the interval (a blade gap) between the developing roller 1 and the developer restriction member 2, and the amount by which the developer head has been raised. Accordingly, the amount of the developer 4 which has passed through the developer restriction member 2 is determined by the height of the developer head.

The image quality is also influenced by the height of the developer head. Namely if the height of the developer is comparatively low and the amount of the developer to be carried to the developing section 9 is thus reduced, sufficient toner for a development is not supplied, which results in a deterioration of the image density. Conversely, if an excessive amount of toner is supplied, the image is unstable.

Namely, a variation in the height of the developer head may cause an instability of the image and a deterioration of the image quality. Accordingly, to eliminate any unevenness of the image quality, it is necessary to maintain the quantity of developer 4 passing through the blade gap of a constant value.

Moreover, even though the blade gap is constant, the quantity of the developer 4 passing through the blade gap is determined by the amount by which the developer resting on the developing roller 1 is raised in the developer restriction member facing section 6.

Therefore, to obtain a firm image quality without unevenness, that condition of the raising of developer head on the developing roller 1 in the developer restriction member facing section 6 should be always the same.

The condition of the raising of the developer is determined by the vertical magnetic flux density at a position opposite to the developer restriction member 2 on the developing roller 1, and as a result, the vertical magnetic flux density at the opposing position must be constant.

FIG. 19 shows the distribution of the vertical component of the magnetic flux density of the conventional developing roller 1. Note, in this specification, the "vertical component of the magnetic flux density" will be hereinafter referred to as "magnetic flux density". The peak portion of the magnetic flux density in the magnetic flux density distribution will be designated as a magnetic pole. This embodiment has five magnetic poles as shown in FIG. 19. The magnetic pole A confronts the photosensitive drum 3, the magnetic poles B, C, and E are mainly used for conveying the developer 4*b*, and a magnetic pole D is mainly used for applying the developer 4 to the developing roller 1. Also, the developer restriction member facing section 6 is positioned between the magnetic poles B and C.

FIG. 20 shows, on an enlarged scale, the distribution of the magnetic flux density of the conventional developer restriction member facing section 6. As clearly shown by the drawing, the conventional developing apparatus suffered from a large change in the vertical component of the magnetic flux density on the developing roller 1 in the developer restriction member facing section 6.

Note, the parts to be mounted in the developing apparatus have respective mounting precision errors which must be allowed for in the fabrication. Namely, if the mounting precision for the developer restriction member 2 is $\pm 0.5$ degrees, if the precision in the magnetized position for the magnet 1*b* is $\pm 3$ degrees, if the fixing precision for the magnet 1*b* $\pm 0.5$ degrees, and if the processing precision of the other parts is $\pm 1$ degree, the position of the developer restriction member 2 relative to the magnetic flux density distribution has a precision as shown by the positional precision range Q. The positional precision range Q is generally within the range of $\pm 5$ degrees of the above-mentioned precision, and becomes 10 degrees in total.

In the conventional developing roller 1, the magnetic flux density in the developer restriction member facing section 6 differs depending on the developing apparatus used, due to the large variation in the magnetic flux density within the positional precision range Q.

As described hereinbefore, the difference in the magnetic flux density causes a variation in the amount of the developer 4 to be carried to the developing section, which has a large affect on the image quality. Accordingly, many different problems arise such as a remarkable difference in the image density depending on the developing apparatus used, a solid, a thin line, a skip in a dots for half torning, and the adherence of the carrier to the photosensitive body.

SUMMARY OF THE INVENTION

An object of the invention is to overcome the conventional disadvantages and to provide a magnetic brush developing apparatus which prevents unevenness in the image quality resulting from a substitution of different developing apparatus, thus leading to an improvement in the image quality, and which has a wider assembly precision range enabling an easy installment of the apparatus.

To achieve the above object, the magnetic brush developing apparatus in accordance with the present invention comprises a developing apparatus containing a developer, a magnet stationarily located in the developing apparatus and having magnetic poles radially provided at a plurality of points, a rotational sleeve arranged so as to cover the outer circumference of the magnet and rotationally driven to convey the developer of the developing apparatus, and a developer restriction member arranged opposite to the rotational sleeve to restrict the amount of the developer carried by the rotational sleeve, wherein, at the position facing the developer restriction member, and in its vicinity, there is formed a uniform magnetic flux density section having a magnetic flux density having a vertical component which is substantially uniform on the periphery of the rotational sleeve.

Further, in the magnetic brush developing apparatus according to the present invention, the uniform magnetic density section may include a distribution of a magnetic flux density having a vertical component which is substantially uniform in a wider range than that of any of a precision in a magnetized position for the magnet, a precision in a mounting of said magnet to the developing apparatus, and a precision in a mounting of the developer restriction member to the developing apparatus. Further, the uniform magnetic flux density section may include a distribution of a magnetic flux density having a vertical component which is substantially uniform in a wider range than that of a precision of a relative mounting position of the uniform magnetic flux density section and of the developer restriction member.

Moreover, the uniform magnetic flux density sections may be provided on both sides of the developer restriction member facing position, to thus extend by an angle of at least 3 degrees, preferably at least 5 degrees, more preferably at least 10 degrees, in terms of the rotational angle of the rotational sleeve.

Furthermore, the uniform magnetic flux density section may have a vertical magnetic flux density within the range of ±20%, preferably ±15%, more preferably ±10% with respect to the preset value for the developer restriction member facing position.

To illustrate the functions of the present invention, FIG. 17 shows the variation in the developer head based on the magnetic flux density distribution of the developer restriction member facing section 6.

FIG. 17(*a*) shows the state of the developer head in the developer restriction member facing section 6 in accordance with the present invention.

In the present invention, the magnetic flux density has a substantially uniform vertical component in the developer restriction facing section 6, so that the condition of raising of the head in this section is substantially uniform.

As a result, even if the mounting position of the developer restriction member with respect to the magnetic flux density distribution is diverged, the condition of raising of the developer is uniform in the developer restriction member facing section 6, so that the amount of the developer 4 to be carried to the developing section 9 passing through the developer restriction member 2 remains unchanged.

FIG. 17(*b*) shows the state of the developer head in the developer restriction facing section 6 of the prior art. In the conventional techniques, the vertical component of the magnetic flux density is changed in the developer restriction member facing section 6, which causes the variation in the state of the head raising in this section.

Consequently, if the mounting position of the developer restriction member 2 with respect to the magnetic flux density distribution is diverged from the design center value 6*a* due to the processing precision of the parts and the like, the head raising of the developer 4 is different in the developer restriction member facing section 6, and thus the amount of the developer 4 to be carried to the developing section passing through the developer restriction member 2 differs depending on the developing apparatus used.

Then, as described earlier, the variation in the amount of the developer 4 influences the image quality, resulting in a different image quality depending on the developing apparatus used.

As described above, in the present invention, a constant uniform image quality can be obtained in an individual developing apparatus, effectively resulting in an improvement in the image quality and a reduction of the processing precision of the parts.

According to the magnetic brush developing apparatus of the present invention, the magnetic flux density in the developer restriction member facing section is almost unchanged even though the relative mounting position is diverged between the magnetic flux density distribution and the developer restriction member, thereby rendering the supply of the developer uniform among different developing devices. As a result, despite the substitution of the developing apparatus, a uniform image quality can be obtained without unevenness, leading to the improvement in the image quality, and a developing apparatus having a wider processing and assembly precision range can be obtained.

According to an aspect of the present invention, there is provided a magnetic brush developing apparatus comprising: a development container for containing a developer; a magnet stationarily located in the development container and having magnetic poles radially provided on a plurality of points thereof; a rotationally sleeve arranged so as to cover an outer circumference of the magnet and rotatably driven to carry the developer in the development container to an image carrying body; a developer restriction member arranged opposite to the rotational sleeve to restrict an amount of the developer carried by the rotational sleeve; two of the magnetic poles being a developing magnetic pole (Pd) facing opposite to the image carrying body and a developer transfer magnetic pole (Pt) located between the developing magnetic pole (Pd) and the developer restriction member; a magnetic brush of the developer formed on the rotational sleeve by the developer transfer magnetic pole (Pt) having a magnetic flux density, and a width or angle ($\theta$) of a region where a radial component of the magnetic flux density exceeds over a half of a maximum value thereof being determined in such a manner that the developer is prevented from flying away from the magnetic brush by a centrifugal force of an arc begin depicted by the magnetic brush of the developer due to the rotation of the rotational sleeve.

Since the half value width of the magnetic flux density on the sleeve surface is widened in the region of the transfer magnetic pole Pt, the arc depicted by the magnetic brush is enlarged and, therefore, the centrifugal force of magnetic brush is reduced. Thus, the speed of the magnetic brush at the tip thereof is reduced, so that the developer is prevented from splashing away from the magnetic brush. Also, the magnetic force ray from the development magnetic pole Pd to the transfer magnetic pole Pt is increased, so that a magnetic suction force of developer is increased, thereby making the development operation in good manner.

BRIEF DESCRIPTION OF THE DRAWINGS

FIG. 8 is a chart showing results of the image evaluation;

FIG. 27 is an explanatory view (Part 1) of the half value width and the void locations in the above embodiment;

FIG. 29 is an explanatory view (Part 2) of the half value width and the void locations in the above embodiment.

DESCRIPTION OF THE PREFERRED EMBODIMENTS

Embodiments of the present invention will now be described with reference to the drawings.

Figure 1:
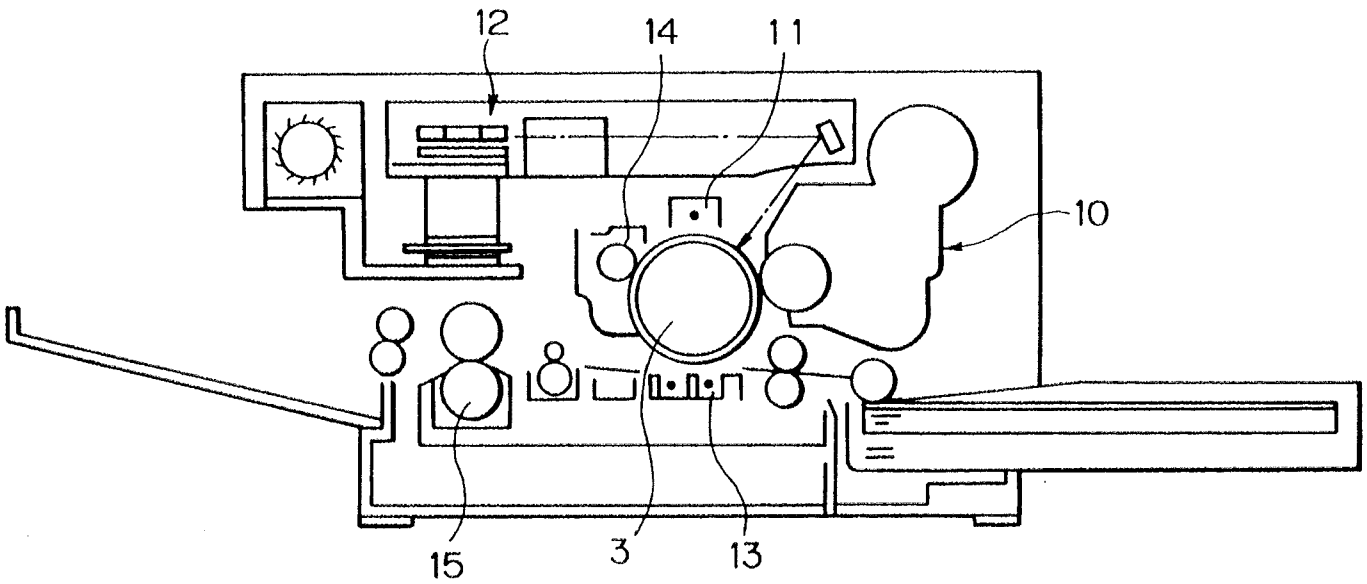
FIG. 1 is a schematic side sectional view of the printer of the embodiment.

FIG. 1 shows an electrophotographic printer. The present invention is widely applicable to not only printers but also copying machines and the like.

In FIG. 1, reference numeral 3 denotes a photosensitive drum rotatable around a shaft thereof, 11 denotes a preelectrostatic charger for electrifying the photosensitive drum 3, 12 represents a light exposure device for exposing the photosensitive drum 3 by a scanned laser beam, to form an electrostatic latent image on the surface of the photosensitive drum 3.

Also, reference numeral 10 represents a magnetic brush developing apparatus for developing the electrostatic latent image formed on the photosensitive drum 3, to form a toner image, 13 designates a transfer device for transferring the toner image onto a printing sheet, 14 designates a cleaner for removing residual toner on the surface of the photosensitive drum 3, and 15 shows a fixing roller for thermally fixing the toner image onto the sheet.

Figure 2:
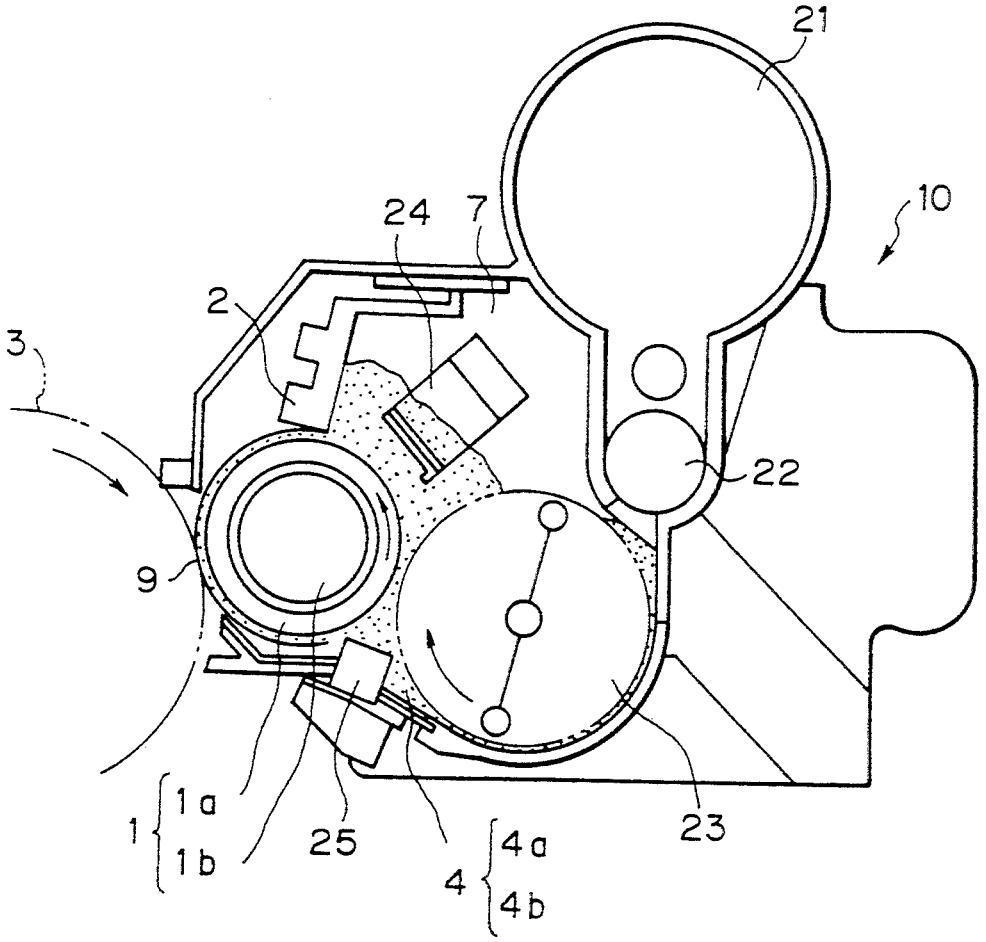
FIG. 2 shows a side sectional view of the developing apparatus of one embodiment.

FIG. 2 shows the developing apparatus 10.

Contained within a development container 7 is a two component developer 4 composed of a toner 4*a*, a colored powder, and a carrier 4*b*, i.e., a magnetic powder. The toner 4*a* is supplied into the development container 7 from a toner hopper 21 provided on the upper portion through a toner supply roller 22.

The toner used in this embodiment is made of styrene acrylic series or polyester series resin and has an average particle diameter of 11 to 12 μm. The carrier, which is a resin-coated magnetic material such as magnetite or ferrite has an average particle diameter of about 100 μm. A saturation magnetization of the carrier is 80 emu/g.

Reference numeral 23 stands for a stirring device for stirring the developer within the development container 7, to produce an electrostatic charge therein. 24 signifies a flow restriction member for returning the developer 4 held back by a developer restriction member 2, to the stirring device 23, and 25 signifies a toner density sensor for detecting a toner density in the developer 4 through a measurement of a permeability of the developer 4, to thereby determine the toner replenishment timing.

The development container 7 has at its left end portion an opening which defines a developing section 9 for developing the surface of the photosensitive drum 3, in which there is provided a developing roller 1 constituted of a cylindrical magnet 1*b* made of a magnetized magnetic material, and a tubular rotational sleeve 1*a* rotatably driven and arranged so as to cover the surface of the magnet 1*b*.

In this embodiment, the magnet 1*b* is made of ferrite and has a shaft made of a non-magnetic material such as aluminum alloy, for example. Also, the rotational sleeve 1*a* is made of the non-magnetic material such as aluminum alloy, for example.

Figure 3:
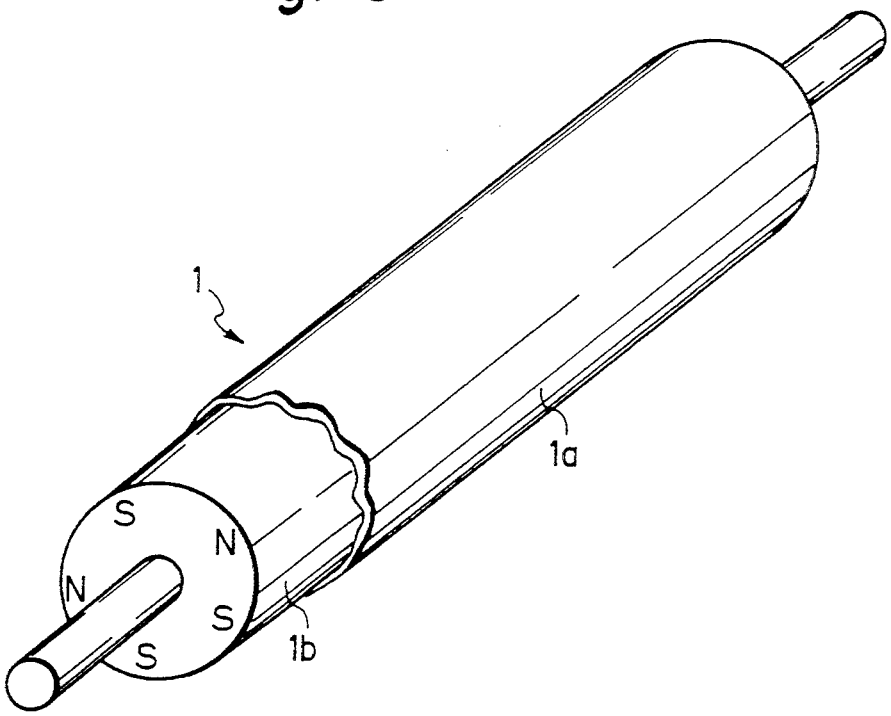
FIG. 3 is a perspective view of the developing roller of the embodiment.

FIG. 3 is a perspective view showing the partially cut-away developing roller 1. The magnet 1*b* shown in FIG. 3 includes a plurality of radially alternately magnetized lines (five lines).

The developer 4 held on the surface of the rotational sleeve 1*a* through a magnetic force exerted by the magnet 1*b*, is carried to the developing section 9 by the rotation of the rotational sleeve 1*a*.

As shown in FIG. 2, a developer restriction member or blade 2 made of a non-magnetized material is rigidly fixed to the development container 7 so as to be parallel to the axial direction of the rotational sleeve 1*a*. Provided between the developer restriction member 2 and the rotational sleeve 1*a* is a predetermined small gap (1.0 mm in this embodiment), and as a result, the height of the developer 4 (the height of the head) carried by the rotation of the rotational sleeve 1*a* is restricted to a predetermined value by the developer restriction member 2.

Then, only the toner which develops the electrostatic latent image formed on the surface of the photosensitive drum 3 is transmitted to the photosensitive drum 3, and the remaining developer 4 is returned to the development container 7 by the developing roller 1.

Figure 4:
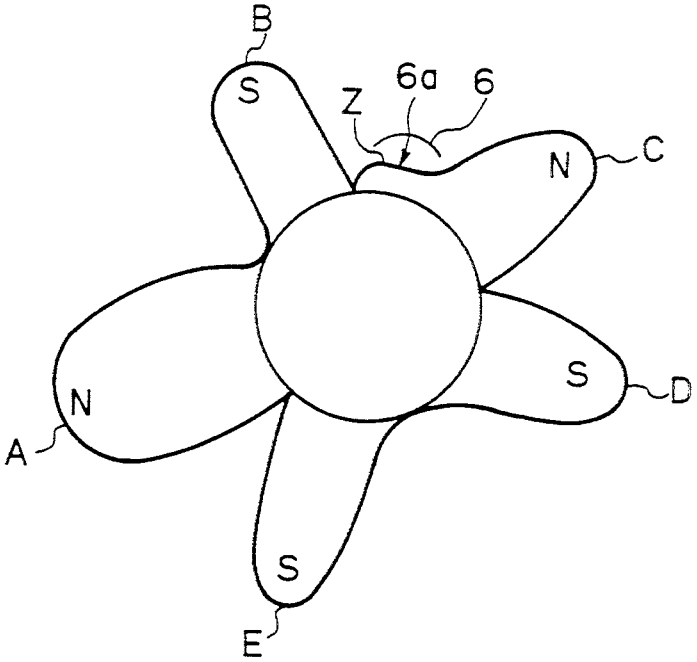
FIG. 4 shows a distribution of the magnetic flux density of the developing roller of the embodiment.

FIG. 4 shows a distribution of the magnetic flux density, in which reference numeral 6 denotes a developer restriction member facing member arranged opposite to the developer restriction member 2.

A magnetic pole A is an N pole confronting the photosensitive drum 3. Magnetic poles B, C, and E are mainly utilized to carry the developer 4, and a magnetic pole D is mainly used to apply the developer 4 to the developing roller 1. Further, the magnetic poles E and D have the same polarity, and therebetween the developer is exfoliated by the developing roller 1. Further, the exfoliated developer 4 is stirred by the stirring device 23 for re-use.

Figure 5:
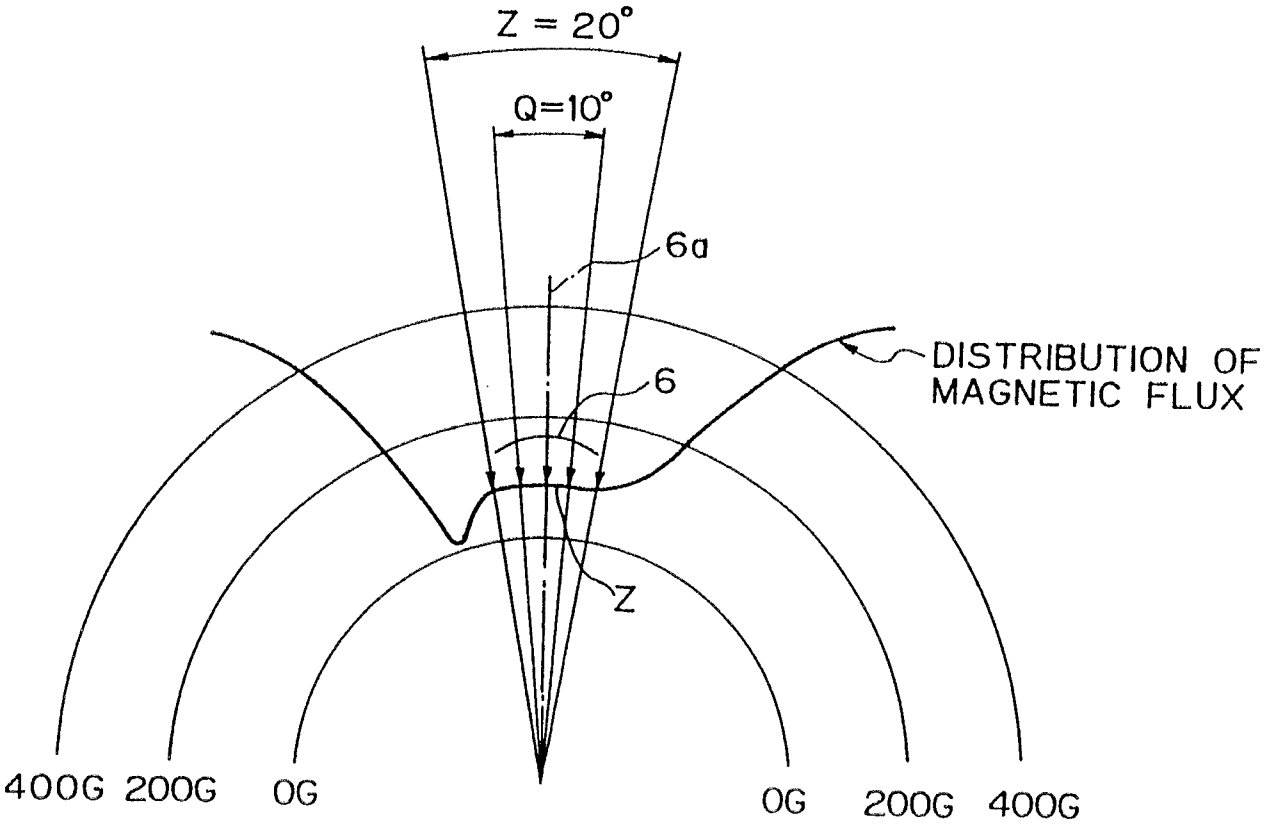
FIG. 5 is a partially enlarged view showing the distribution of the magnetic flux density of the developing roller of the embodiment.

As shown in the enlarged view of FIG. 5, between the magnetic poles B and C the developer restriction member facing section 6 has a substantially uniform magnetic flux density of, for example, 80 to 90 gauss, due to the magnetic pole C.

That magnetic flux density lying between 80 to 90 gauss is suitable to obtain a satisfactory image in the apparatus of this embodiment, the magnitude of which may be appropriately selected depending on the properties of the apparatus.

The uniform magnetic flux density section Z is made to extend across 10 degrees or more and is 20 degrees in total at both sides of the developer restriction member facing the position 6*a* therebetween.

Methods of forming the thus widely spread uniform magnetic flux density section Z will be described later in detail.

As described earlier, the parts mounted in the apparatus have respective mounting precisions (errors permissible in the manufacture) and the like. Accordingly, when the mounting precision of the developer restriction member 2 is ±0.5 degrees, the magnetized positional precision of the magnet 1*b* is ±3 degrees, the fixing precision of the magnet 1*b* is ±0.5 degrees, and the processing precision of the other parts is ±1 degree, the position of the developer restriction member 2 relative to the magnetic flux density distribution of the developing roller 1 includes a precision shown by a positional precision range Q.

Q is on the order of 10 degrees (±5 degrees), and the uniform magnetic flux density section Z is formed so as to be substantially double the Q in this embodiment.

As a result, the magnetic flux density of the developer restriction member facing section 6 is almost unchanged, and accordingly, even if a different developing apparatus is used, the amount of developer 4 supplied to the developing section 9 is unchanged in each developing apparatus.

Figure 6:
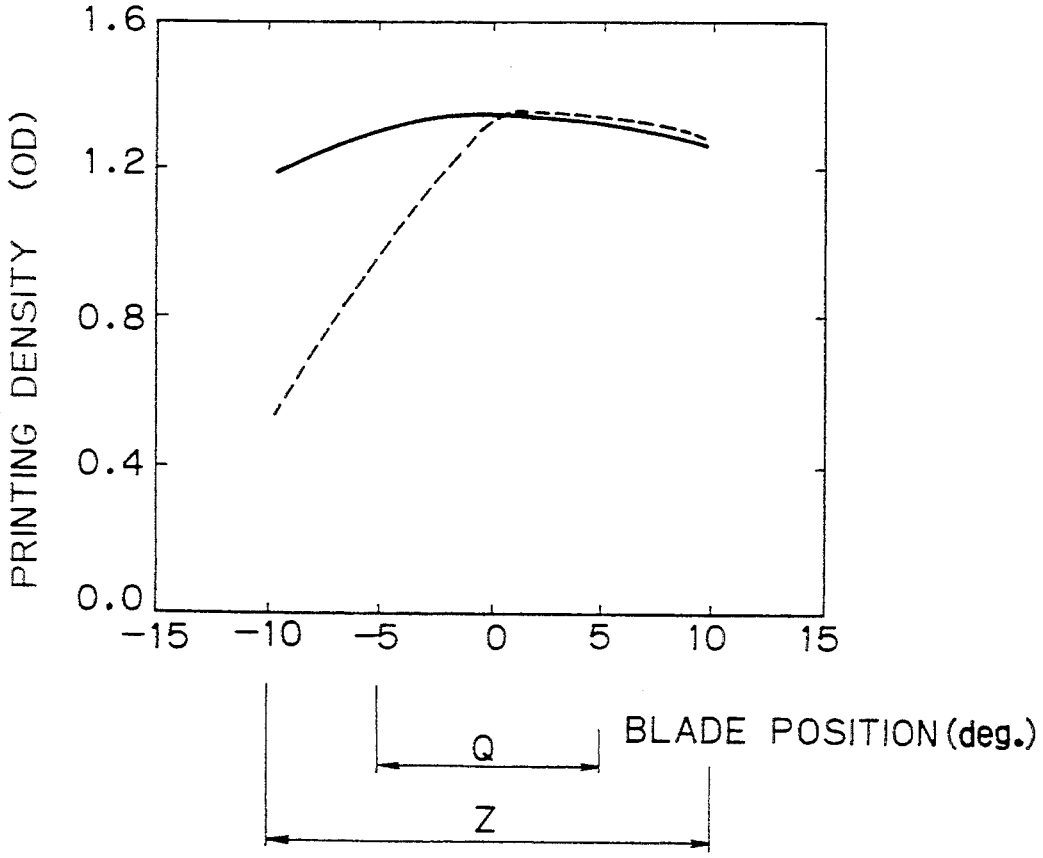
FIG. 6 is a graph showing a relationship between the position of the developer restriction member and the printing density.
Figure 7:
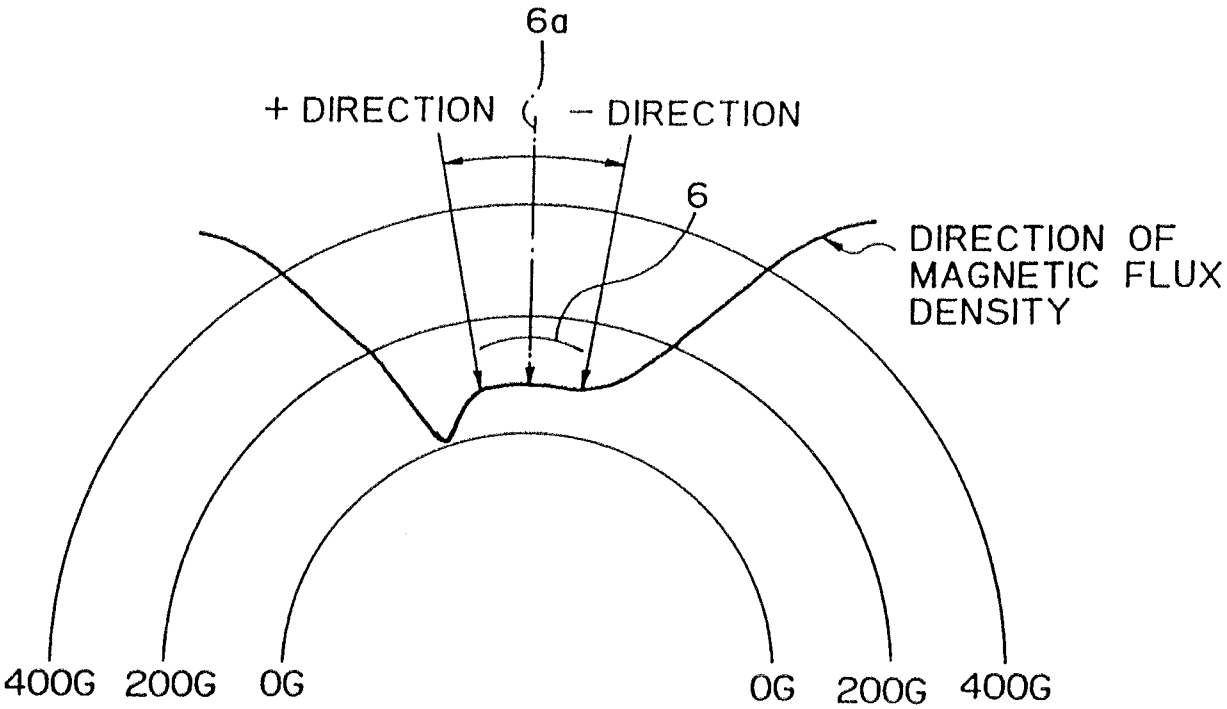
FIG. 7 is a graph showing a relative position of the developer restriction member with regard to the magnetic flux density distribution.

FIG. 6 is a graph showing the relationship between the relative positional variation of the developer restriction member 2 with respect to the magnetic flux density distribution of the developing roller 1, and the printing density (developing density). FIG. 7 shows the + or − direction of the graph. The variation in the relative position of the developer restriction member with respect to the magnetic flux density distribution of the magnet, toward the directions as shown in the drawing, are designated by + and −, respectively.

A solid line in FIG. 6 shows the apparatus of this embodiment, and a broken line shows the conventional apparatus. As can be seen, this embodiment apparatus is subjected to very little change in the printing density regardless of the position of the developer restriction member 2 within the positional precision range Q.

Therefore, each developing apparatus can present a similar uniform image quality within a predetermined range, with respect to the image density, fogging, skip, carrier adhesion and the like.

FIG. 8 shows the angle range for the uniform magnetic flux density section Z of the developing roller used in the developing apparatus, and the ratio of the developing apparatus by which a satisfactory printing can be obtained when the variation range of the magnetic flux density is changed. The image density of a 4 mm square solid of an output image was determined to be satisfactory at 1.2 or over.

In the drawing, "o" means that the ratio (good ratio of the apparatus) of the developing apparatus at which a satisfactory printing can be obtained is approximately 100%, "o" means that the ratio (good ratio of the apparatus) of the developing apparatus at which a satisfactory printing can be obtained is 80% or more, Δ signifies that the ratio (good ratio of the apparatus) of the developing apparatus at which a satisfactory printing can be obtained is 60% or more, and x signifies that the ratio (good ratio of the apparatus) of the apparatus at which a satisfactory printing can be obtained is 50% or less. It will be appreciated from FIG. 8 that the developing apparatus using a developing roller having a uniform magnetic flux density section Z with a wider angle range, and having a narrower variation angle of the magnetic flux density within the foregoing angle range, is able to obtain a satisfactory printing with a 1.2 or more image density.

For example, for the developing apparatus using a developing roller (as used in the embodiment in FIG. 6) having an angle range of ±10 degrees or more and having a variation range of the magnetic flux density of ±10 or less, the good ratio of the apparatus was almost 100%, which is an ideal result.

On the contrary, for the developing apparatus using a developing roller having an angle range of +5 degrees or more, and the variation range of the magnetic flux density of ±15% or less, the good ratio of the apparatus was 80% or more, and for the developing apparatus using a developing roller having an angle range of ±3 degrees and the variation range of the magnetic flux density of ±20%, the good ratio of the apparatus was 60% or more.

For the developing apparatus using a developing roller having an angle range of ±2 degree or less and the variation range of the magnetic flux density of ±25%, or more, the good ratio of the apparatus was 50% or less, which is unusable in practice.

Also, in the case of the developing apparatus using a developing roller having an angle range of ±2 degrees or less, and the variation range of the magnetic flux density of +10 or less, as well as the developing apparatus using a developing roller having an angle range of ±10 degrees or more and an variation range of the magnetic flux density of ±25% or more, the good ratio of the apparatus was not less than 60%.

From the above experimental results, it is understood that the uniform magnetic flux density section Z should be formed to extend by 3 degrees, preferably by 5 degrees, more preferably 10 degrees in terms of angle range on both sides of the developer restriction member facing section 6 therebetween, more preferably, a 5 degrees angle range or more, most preferably a 10 degrees angle range or more.

It is also understood that the vertical magnetic flux density of the uniform magnetic flux density section Z should lie within a range of ±20%, preferably ±15%, more preferably ±10% with respect to the preset value at the developer restriction member facing section 6.

In these experiments, 16 kinds of developing rollers were used to measure 20 rollers each.

A description is now given of a method of fabricating a developing roller lying within the angle range and the variation range of the magnetic flux density as described above.

Figure 9:
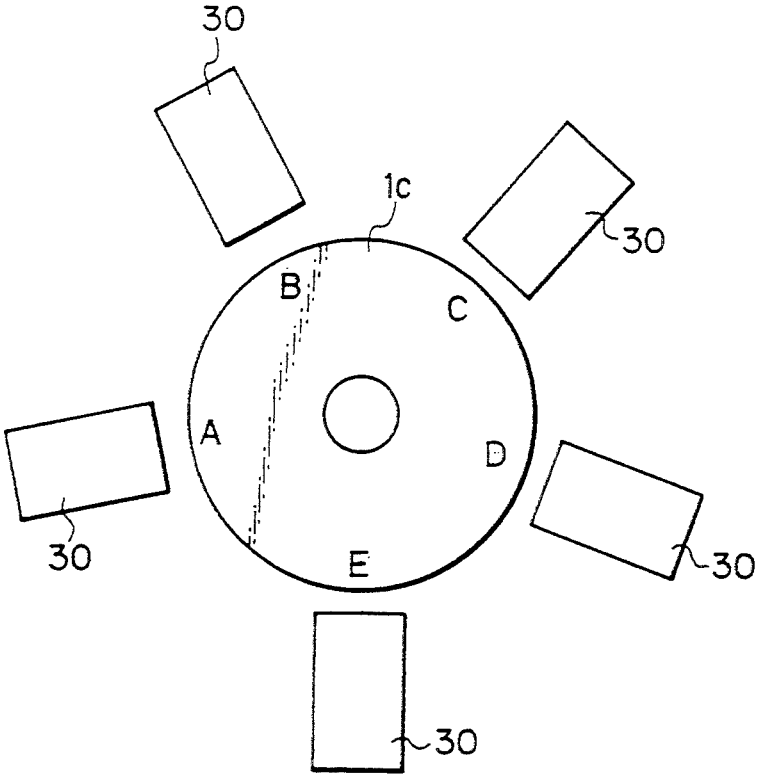
FIG. 9 is an explanatory drawing showing the magnetization principle.

First, the magnetizing of the magnet 1*b* will be described with reference to FIG. 9.

As shown in the drawing, an electromagnet 30 is arranged surrounding a magnet raw material 1*c*. A coil (not shown) of the electromagnet 30 is then energized to exert a magnetic force on the electromagnet 30, to thereby magnetize the magnet raw material 1*c* to form a magnet 1*b*. In this case, the range of the angular position of each magnetic pole is determined by the angular positional arrangement of the electromagnet 30, and the magnitude of the magnetic flux density of each magnetic pole is determined by the current supplied to the coil of the electromagnet 30.

Figure 10:
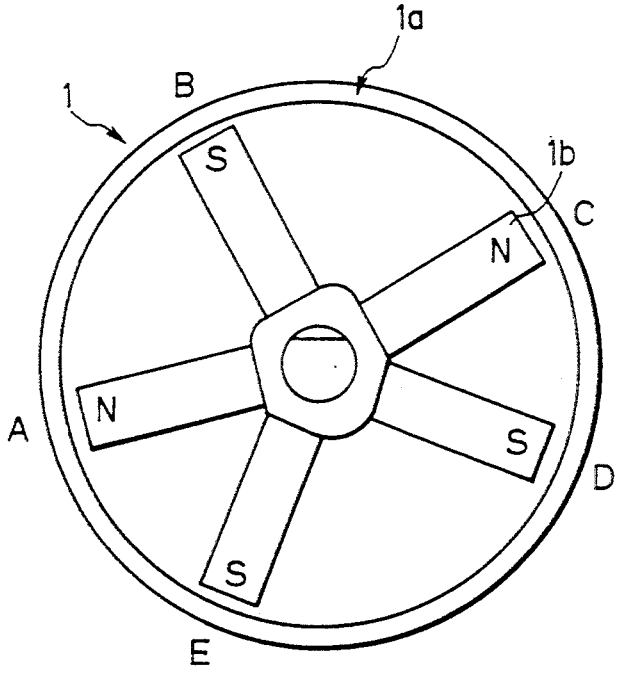
FIG. 10 is a lateral view of the developing roller of another embodiment.

FIG. 10 shows a developing roller of another embodiment in accordance with the present invention. In the drawing, the magnet 1*b* has a shaft having planes to which magnets are attached, and through an appropriate magnetic flux density and the angle arrangement, a satisfactory distribution of the magnetic flux density can be obtained.

Methods of forming a uniform magnetic flux density section Z will now be described with reference to FIGS. 11 to 16.

Figure 11:
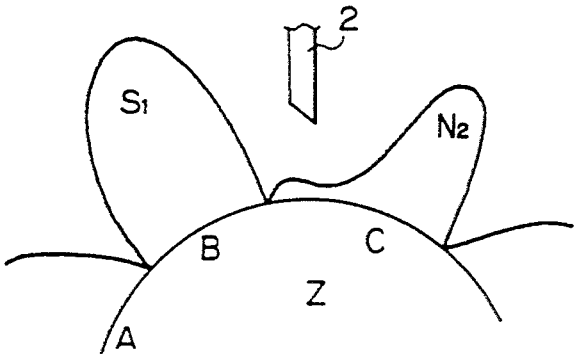
FIG. 11 shows the relationship between the blade and the magnetic poles B and C.

FIG. 11 shows the relationship between the positions of the developer restriction member or blade 2 and the two magnetic poles B and C located on the circumference of the developing roller 1 and between these magnetic poles B and C. There are two methods of forming the uniform magnetic flux density section Z, one being attained by a balance control between the two magnetic poles B and C located between these magnetic poles B and C, and the other being attained by providing a new magnetic pole C′ in the vicinity of the developer restriction member (blade) 2.

Figure 12A:
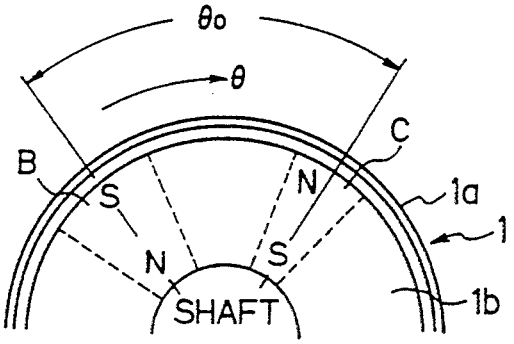
FIGS. 12(*a*)–12(*b*) show a developing roller and the distribution of the magnetic flux density.
Figure 12B:
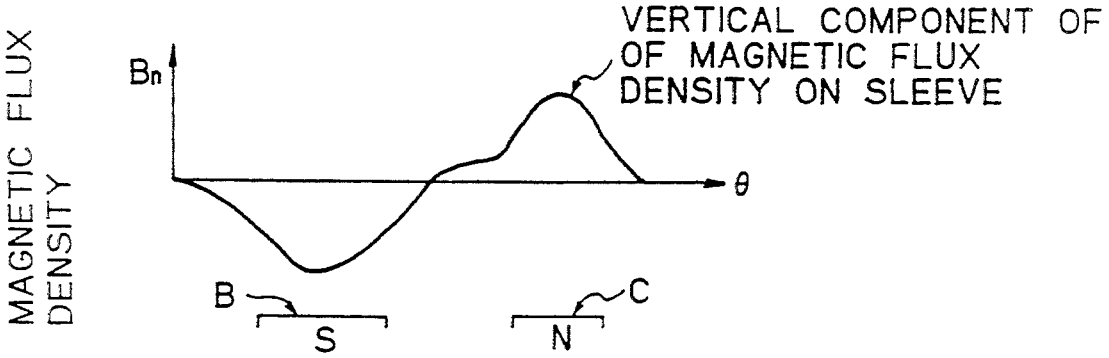

In FIG. 12(*a*) shows a structure of the developing roller and FIG. 12(*b*) shows the vertical component of the magnetic flux density distribution on the rotational sleeve 1*a* of the developing roller 1. As mentioned hereinbefore, the developing roller 1 comprises the rotational sleeve 1*a* and the magnet 1*b*. An isotropic ferrite magnet is used as a material of the magnet 1*b*. As shown in FIG. 12(*a*), if an external magnetic field is exerted on such a magnet material, the magnetic poles (A, B, C, . . . ) are formed. FIG. 12(*b*) shows the results of the measurements of the magnetic flux density distribution on the rotational sleeve 1*a*. The positions of the magnetic poles B and C are shown at the bottom of the drawing. In FIG. 12(*b*), the abscissa indicates an angle $\theta$.

(1) Balance Control of Magnetic Poles

Figure 13A:
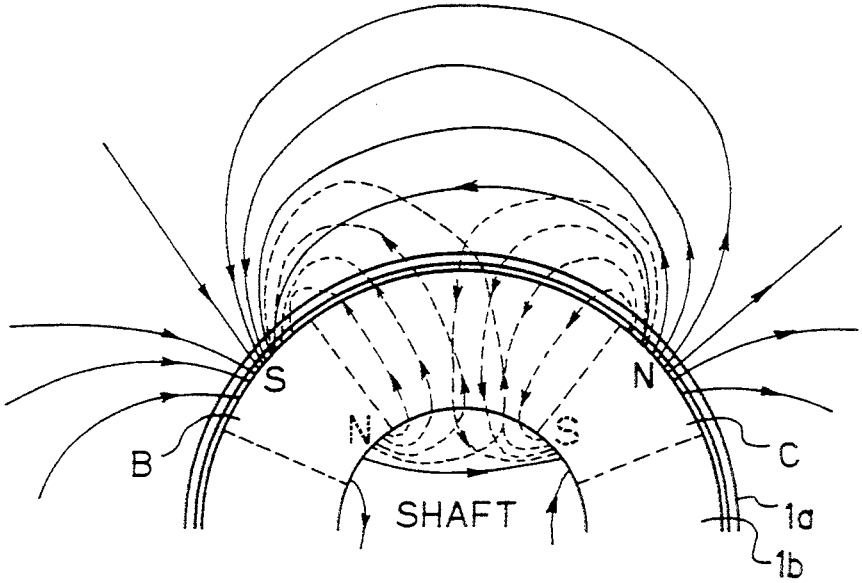
FIGS. 13(*a*)–13(*c*) illustrate a method of forming a uniform magnetic flux density section by a balance control between the two magnetic poles B and C.
Figure 13B:
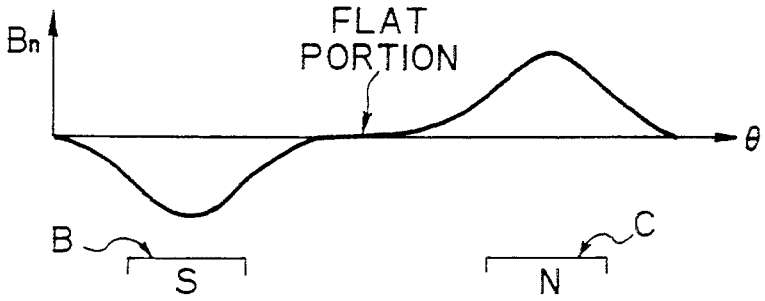
Figure 13C:
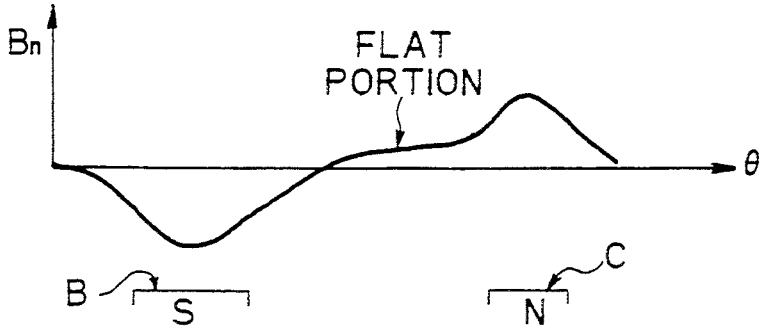

A method of forming an uniform magnetic flux density section Z by a balance control between the two magnetic poles B and C, between which the developer restriction member or blade 2 is arranged is now described. If the distance between the two magnetic poles B and C is increased, as shown in FIG. 13(*a*), not only does the magnetic flux flow from the magnetic pole C (N-pole) toward the magnetic pole B (S-pole), but also the magnetic flux flows toward the inner magnetic poles located at the side of a shaft of the developing roller, as shown by broken lines in FIG. 13(*a*), and thus, both magnetic fluxes are mutually balanced so that a flat portion is formed. If the strength of magnetization and the width of these two magnetic poles B and C are the same, the flat portion is located at a zero line of the magnetic flux density, but if the strength of magnetization of one of the magnetic poles B and C is smaller than that of the other, or if the width of one is narrower than that of the other, the flat portion is not located at the zero line. For example, if the width of the magnetic pole C (N-pole) is narrower, the amount of the magnetic flux around the magnetic pole B (S-pole) is increased, and therefore, the flat portion is moved to the side of N-pole, and thus a uniform magnetic flux density section Z is formed at the side of N-pole, as shown in FIG. 13(*c*).

Therefore, in a method of obtaining a balance control between the two magnetic poles B and C, a uniform magnetic flux density section (flat portion) Z can be advantageously formed if the angle $\theta_0$ (FIG. 12(*a*)) between the center lines of the two magnetic poles B and C is not less than three times the average width of these magnetic poles B and C, and if the width of one of the magnetic poles B and C is smaller (not more than 80%) than that of the other, or the magnetic flux density of one is smaller than that of the other.

(2) Provision of a New Magnetic Pole C'

Figure 14A:
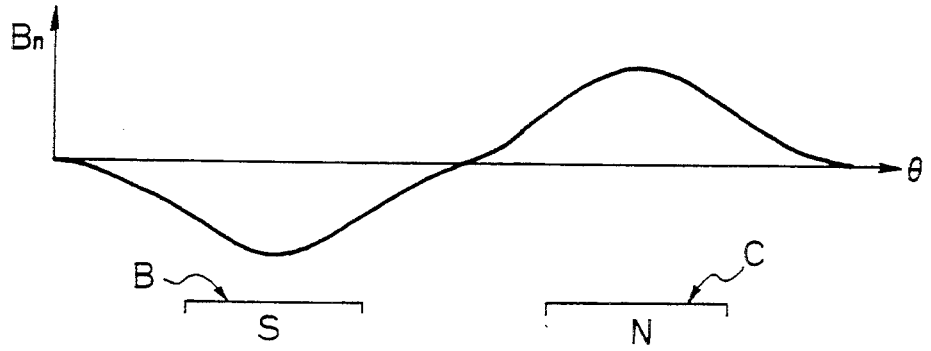
FIGS. 14(*a*)–14(*c*) illustrate another method of forming uniform magnetic flux density section by providing a new magnetic pole C'.
Figure 14B:
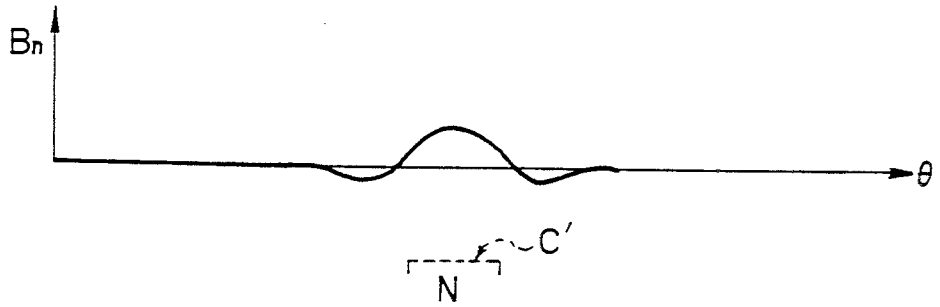
Figure 14C:
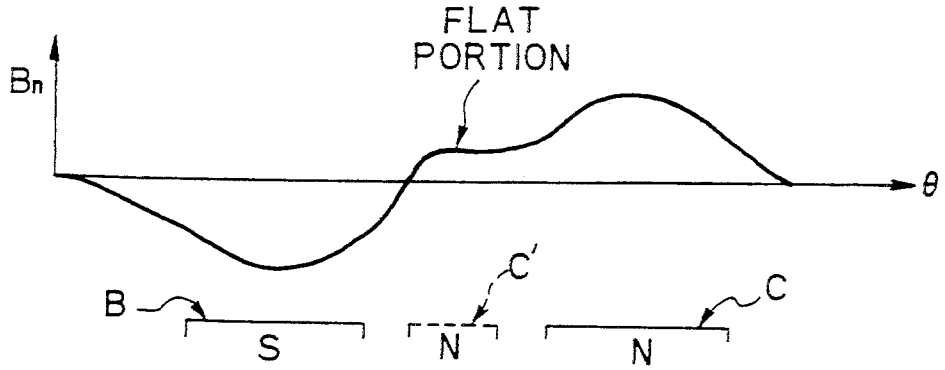

A method of forming a uniform magnetic flux density section Z by providing a new magnetic pole C' will now be described with reference to FIG. 14. As mentioned above (1), if the distance between the two magnetic poles B and C is increased, a change of the magnetic flux density will be lost and will not be flat, as shown in FIG. 14(*a*). Therefore, a new magnetic pole C' is arranged between the two magnetic poles B and C and opposite the developer restriction member or blade 2. The distance between the magnetic poles B and C' is a little bit shorter than the distance between the magnetic poles C' and C. The width of the magnetic pole C' is about one half that of the magnetic pole B or C and the strength of magnetization of the magnetic pole C' is about 5 to 50% that of the magnetic pole B or C. FIG. 14(*b*) shows a distribution of magnetic flux density of this magnetic pole C' on the rotational sleeve 1*a*. The distribution of magnetic flux density between the magnetic poles B and C is represented as a combination of both, and thus a uniform magnetic flux density section Z is formed, as shown in FIG. 14(*c*).

Therefore, a uniform magnetic flux density section (flat portion) Z can be advantageously formed by providing a new magnetic pole C', the width of which is about a half that of the magnetic pole B or C and a strength of magnetization thereof is about 5 to 50% of that of the magnetic pole B or C, at a position between the developer restriction member or blade 2 and the two magnetic poles B and C. In this case, the angle $\theta$, (FIG. 12(*a*)) between the center lines of the two magnetic poles B and C is not less than twice the average width of these magnetic poles B and C.

Figure 15:
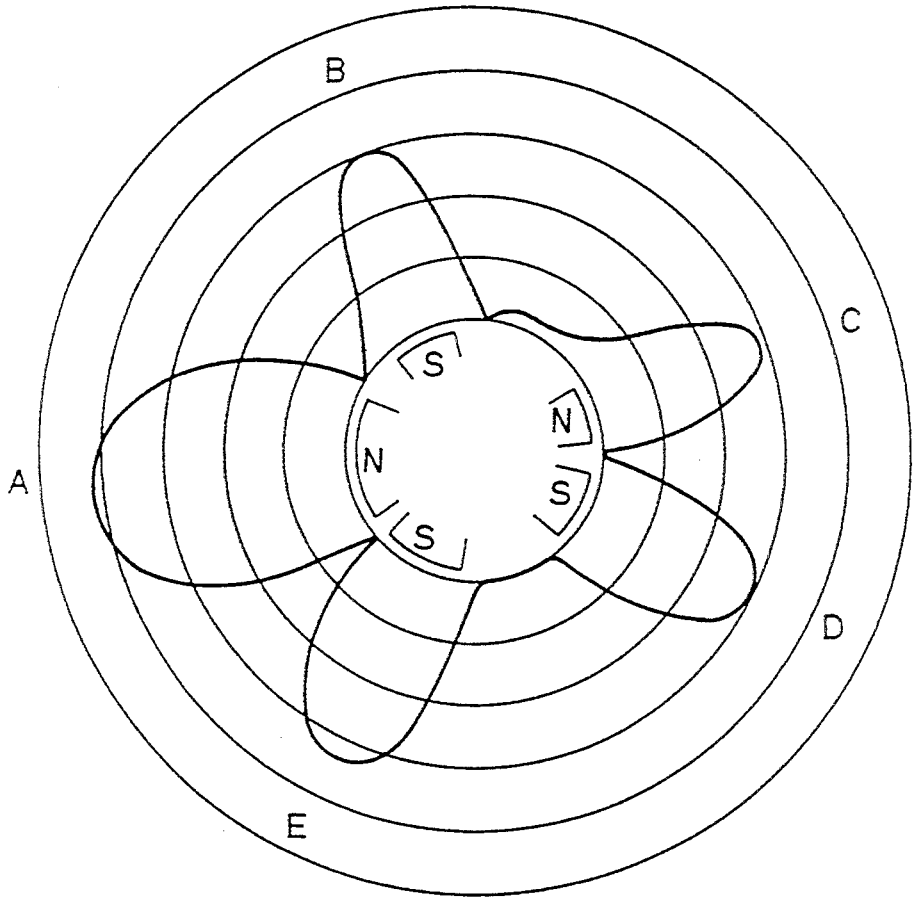
FIG. 15 shows a distribution of the magnetic flux density in the embodiment of FIGS. 13(*a*)–13(*c*)
Figure 16:
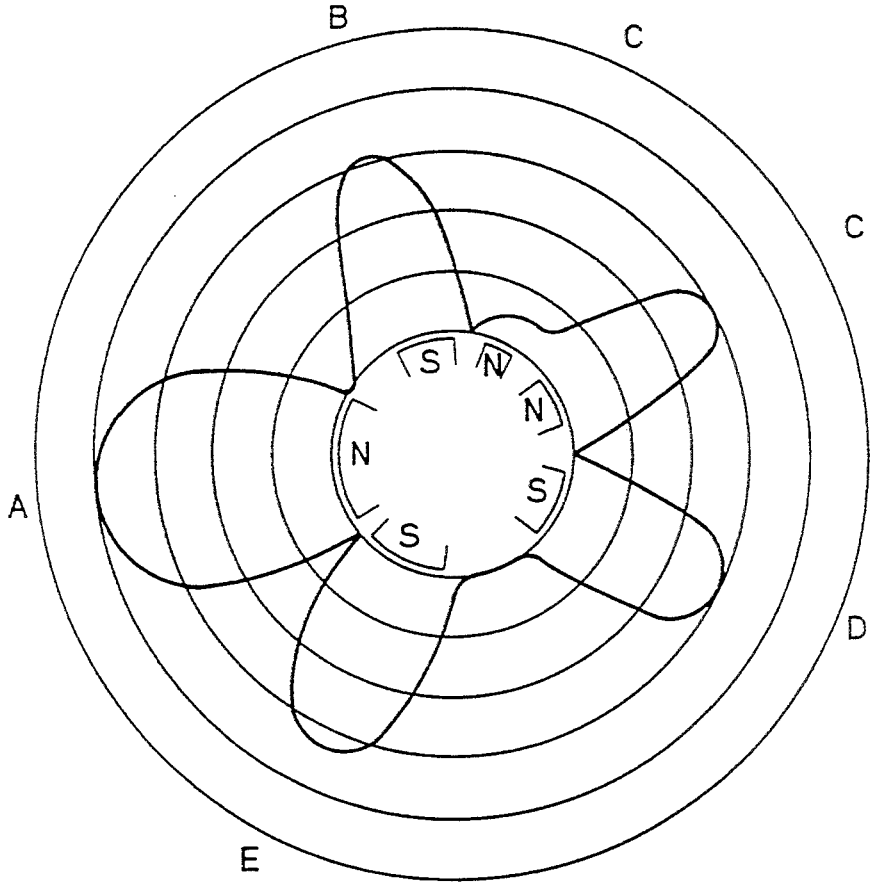
FIG. 16 shows a distribution of the magnetic flux density in the embodiment of FIGS. 14(*d*)–14(*c*)
Figure 17A:
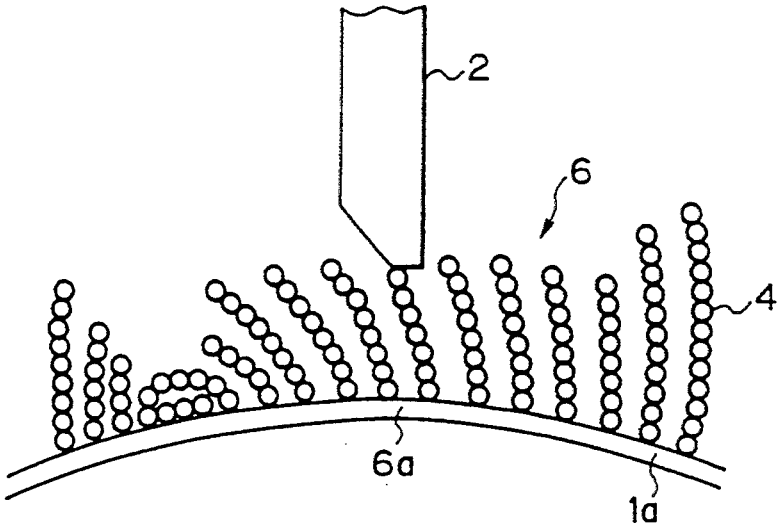
FIGS. 17(*a*)–17(*b*) are a partially enlarged views showing the state of the developer head.
Figure 17B:
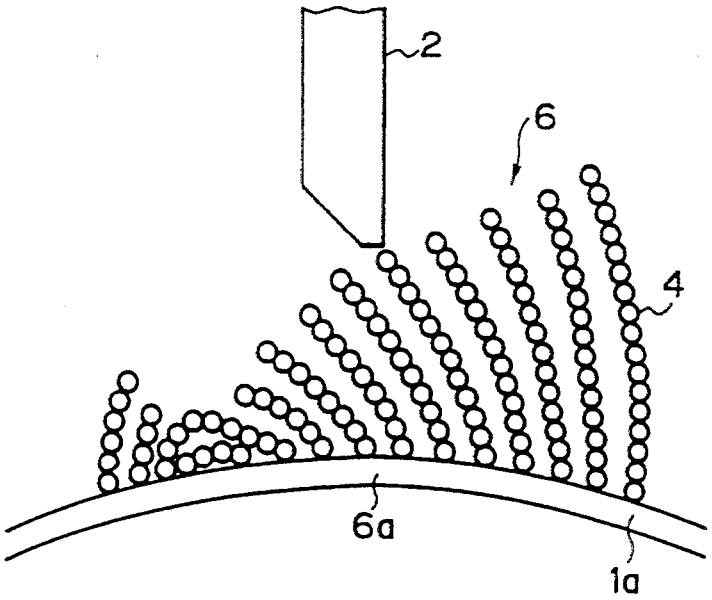
Fig. 17(b) PRIOR ART
Figure 18:
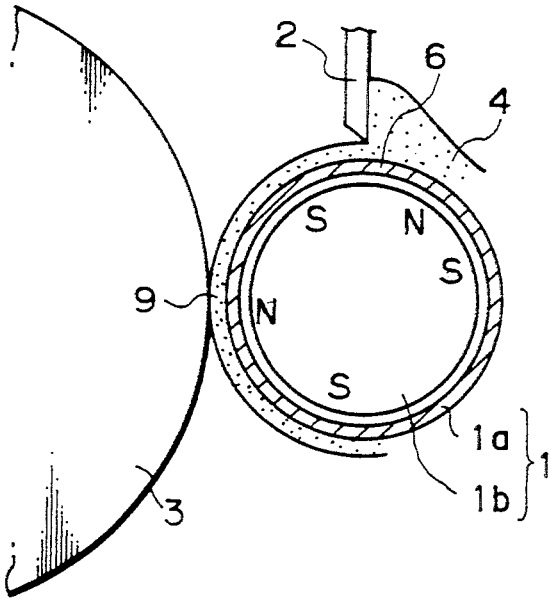
Fig. 18 PRIOR ART
FIG. 18 is an explanatory drawing of the principle of the developing apparatus.
Figure 19:
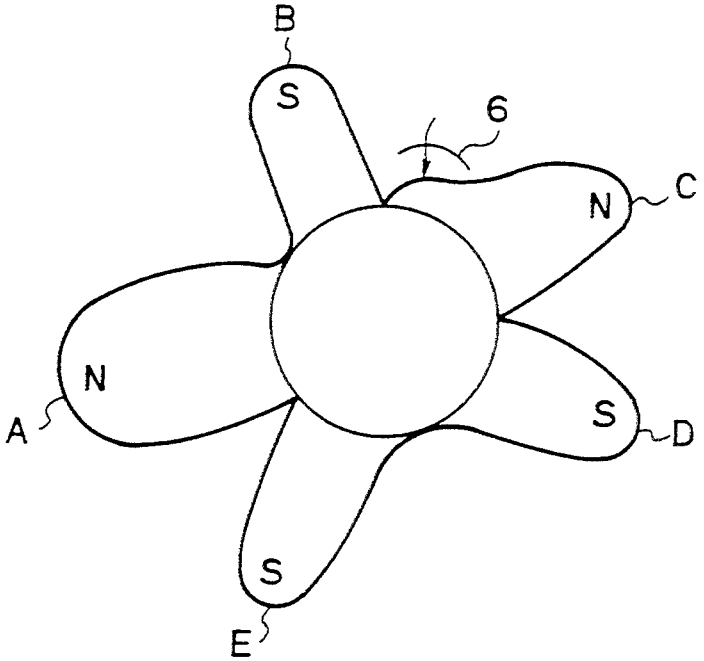
Fig. 19 PRIOR ART
FIG. 19 shows a distribution of the magnetic flux density of the developing roller of the conventional example.
Figure 20:
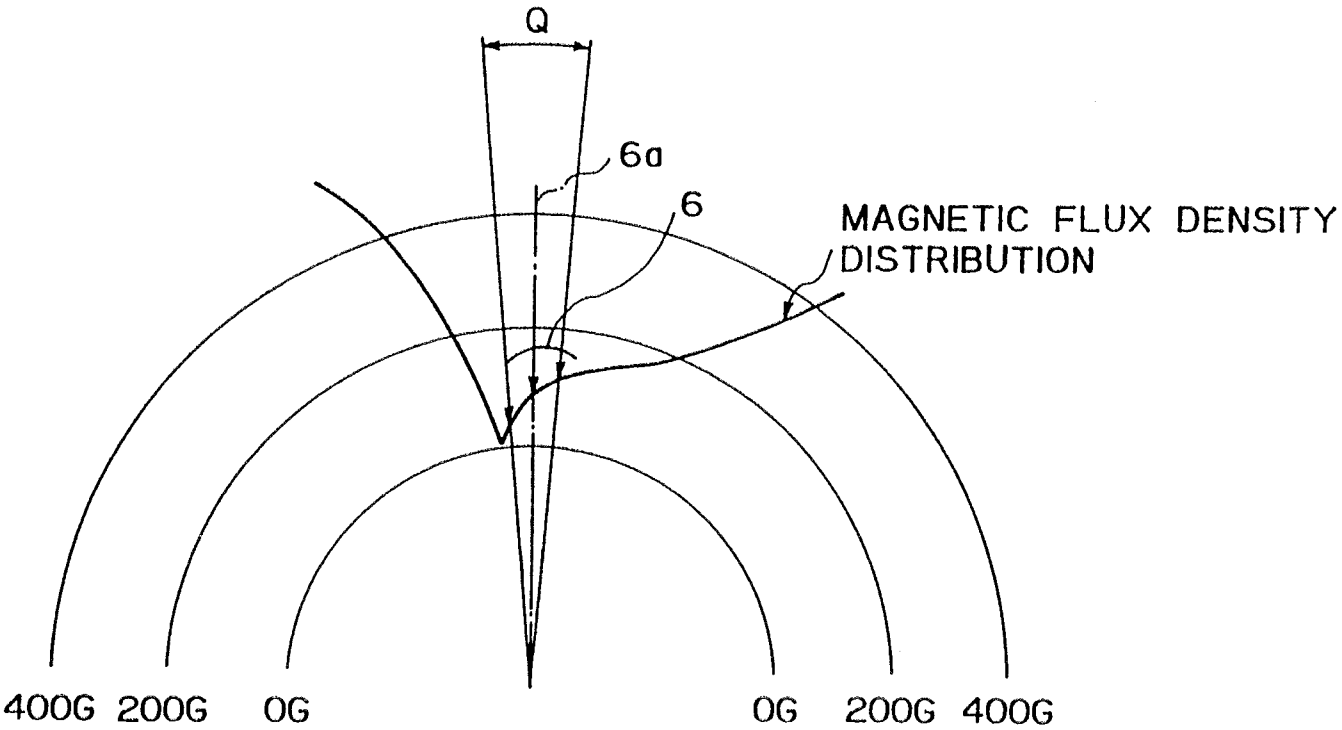
Fig. 20 PRIOR ART
FIG. 20 is a partially enlarged view of the magnetic flux density distribution of the developing roller of the conventional example.

FIGS. 15 and 16 show a distribution of the magnetic flux density in the above-mentioned embodiments (1) and (2), respectively. In FIG. 15, the strength of magnetization of the magnetic poles A, B, C, D and E is the same, but the width thereof is changed as follows. Also the positions of these magnetic poles A, B, C, D and E are set as follows.

| Magnetic pole | Pole | Magnetization strength | Width | Position |
|---|---|---|---|---|
| A | N | 1.8 (KG) | 60° | 0 |
| B | S | same | 30° | 75° |
| C | N | same | 25° | 167.5° |
| D | S | same | 35° | 212.5° |
| E | S | same | 40° | 300.0° |

In FIG. 16, the strength of magnetization and the width of the magnetic poles A, B, C, C', D and E are set as follows. Also the positions of these magnetic poles are set as follows.

| Magnetic pole | Pole | Magnetization strength | Width | Position |
|---|---|---|---|---|
| A | N | 1.8 (KG) | 60° | 0 |
| B | S | 1.8 (KG) | 30° | 80° |
| C | N | 0.2 (KG) | 15° | 117.5° |
| C' | N | 1.8 (KG) | 25° | 157.5° |
| D | S | 1.8 (KG) | 35° | 212.5° |
| E | N | 1.8 (KG) | 40° | 300.0° |

It should be noted that the present invention is not confined to the above embodiments. With respect to the uniform magnetic flux density section Z, providing there exists an appropriate magnetic flux density (for example, 80 to 90 gauss) within the range of at least 5 degrees or more, and 10 degrees or more in total on the both sides of the designed developer restriction member facing point 6*a* therebetween, the image quality among the apparatuses can be made largely uniform compared to the conventional apparatuses.

Also, the above angle may be made at least 3 degrees or more on both sides thereof, and 6 degrees or more in total, to obtain a better effect.

Figure 21A:
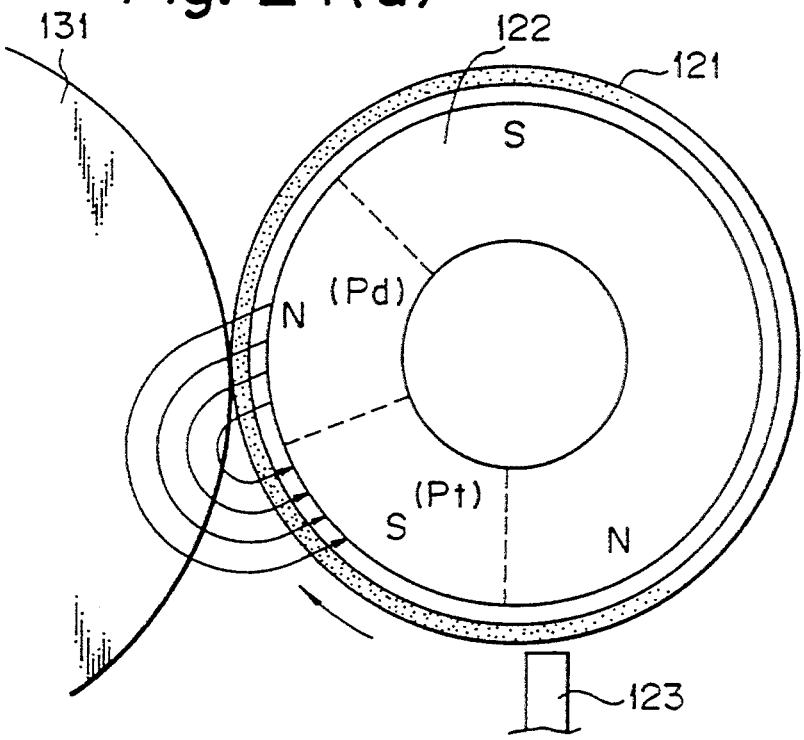
FIGS. 21(*a*) and 21(*b*) are principle diagrams of still another embodiment of the present invention.
Figure 21B:
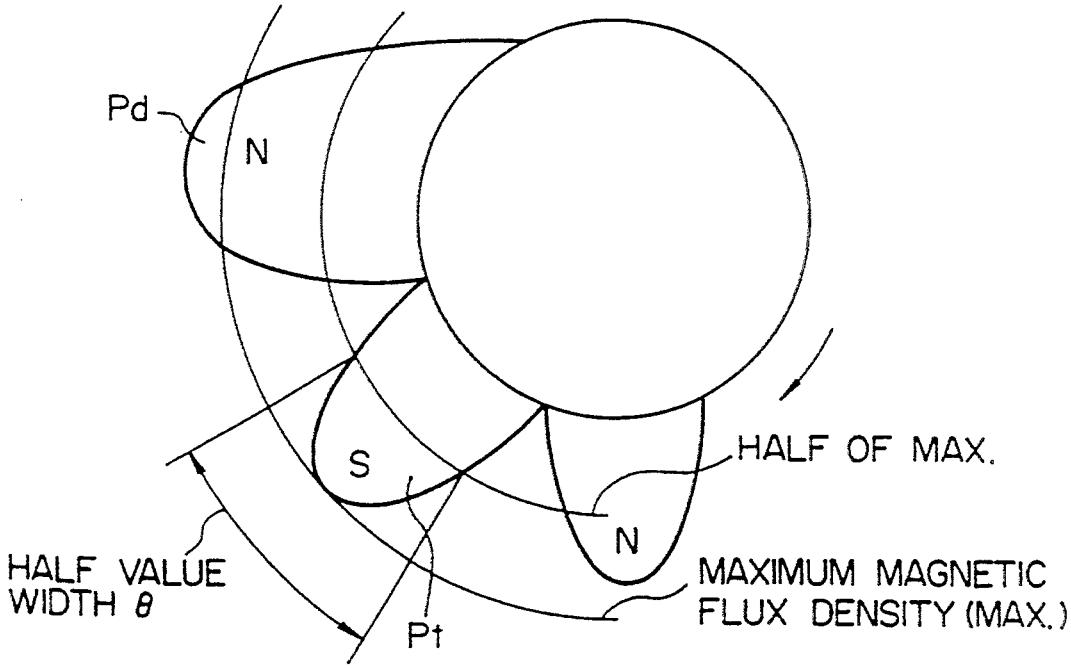

FIGS. 21(*a*) and 21(*b*) are principle diagrams of still another embodiment of the present invention.

In a magnetic brush developing apparatus having at least a developing roller 120 equipped with a magnet 122 to which a plurality of magnetic poles are arranged and a sleeve 121 installed for its free rotation around said magnet 122 and also a restriction member 123 for restricting the carried volume of developer containing the magnetic body particles of the sleeve 121, forming a magnetic brush of the developer on the sleeve 121 and transferring and developing it to an image carrying body 131. A half value width ($\theta$) of magnetic flux density on the surface of sleeve 121 of the transferred magnetic pole Pt between the developing magnetic pole Pd facing opposite to the image carrying body 131 and the restriction member 123 to the value for the developer not to fly away from the magnetic brush by the centrifugal force depicted by the crest of magnetic brush of the developer entailed in the rotation of the sleeve 121.

Because the arc being depicted by the magnetic brush is enlarged and the speed of magnetic brush tip is lowered with the subsequent reduction in its centrifugal force by widening the half value width of the magnetic flux density on the surface of sleeve 121 of the transfer magnetic pole Pt as the value for the developer not to splash away from the magnetic brush by the centrifugal force being depicted by the magnetic brush of the developer involved in the rotation of sleeve 121, the developer at the magnetic brush tip can be prevented from being splashed away.

Moreover, the magnetic force ray is increased to the transfer magnetic pole Pt from the development magnetic pole Pd with an increased magnetic suction force of developer, so the development can be made in a better manner.

It is preferable that the angle between the crest point of the restriction member 123 and the closest point of the developing roller 120 to the image carrier 131 is approximately 90° and the half value width of the transfer magnetic pole Pt and the magnetic flux density is 28° or more.

If the angle between the crest point of restriction member 123 and the closest point of developing roller 120 and the image carrier 131 is set to approximately to 90° and if the half value width of transfer magnetic pole Pt and the magnetic flux density is also set to more than 28°, the developer can be prevented from being splashed away by the centrifugal force due to the arc being depicted by the crest of the magnetic brush.

It is also preferable that the magnetic flux flat area is provided at the position opposite to the restriction member 123 of the developing roller 120.

Because a magnetic flux density flat portion is provided to the position opposite to the restriction member 123 of developing roller 120, the angle formed by the crest of the magnetic brush can be uniformed. This means that, even if there is any positional deviation between the restriction member 123 and the transfer magnetic pole P2 and the mounting position margin of the restriction member 123, the height of developer can be restricted to a certain level. Also, because the angle formed by the crest of the magnetic brush becomes smaller in the flat portion against its upright direction, the rotary torque of sleeve 121 can also be decreased.

It is also preferable that the developer is two-component developer. The carrier will not adhere to the image carrying body because the developer is of two-component one, and any void printing by the carrier can be prevented because the carrier can be prevented from splashing away to the paper.

Figure 22:
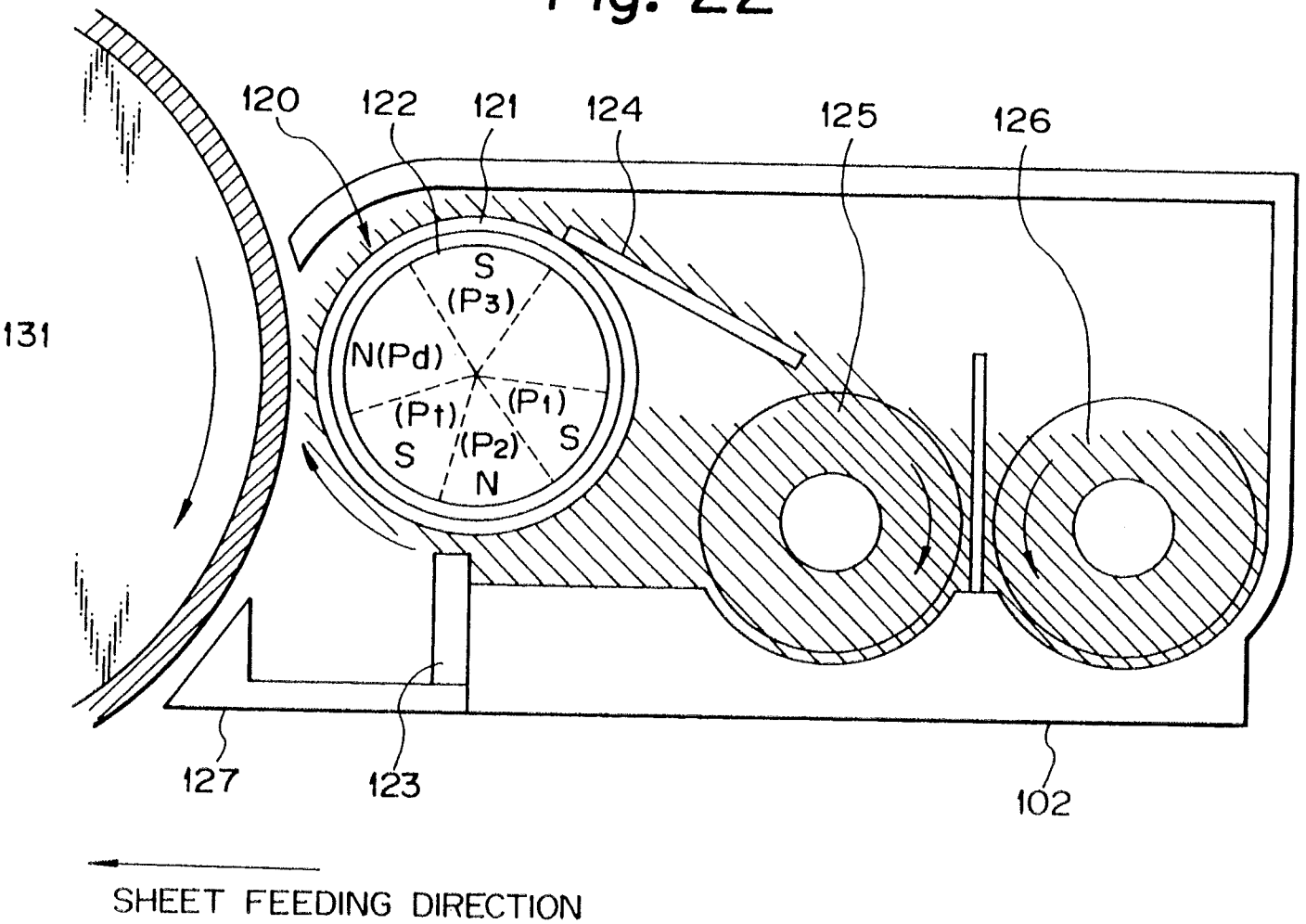
FIG. 22 is a block diagram of the above embodiment of this invention.
Figure 23:
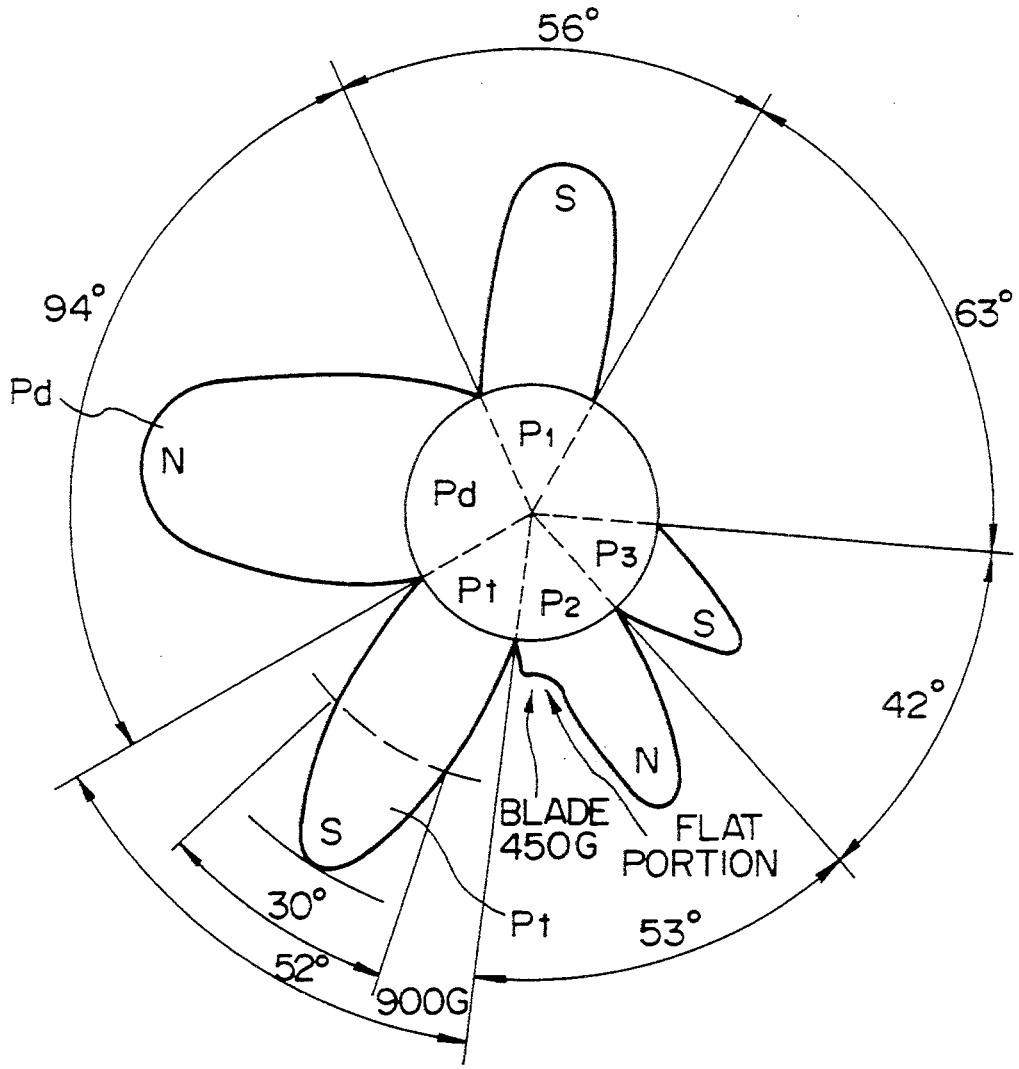
FIG. 23 is a magnetic flux distribution view in the above embodiment.
Figure 24:
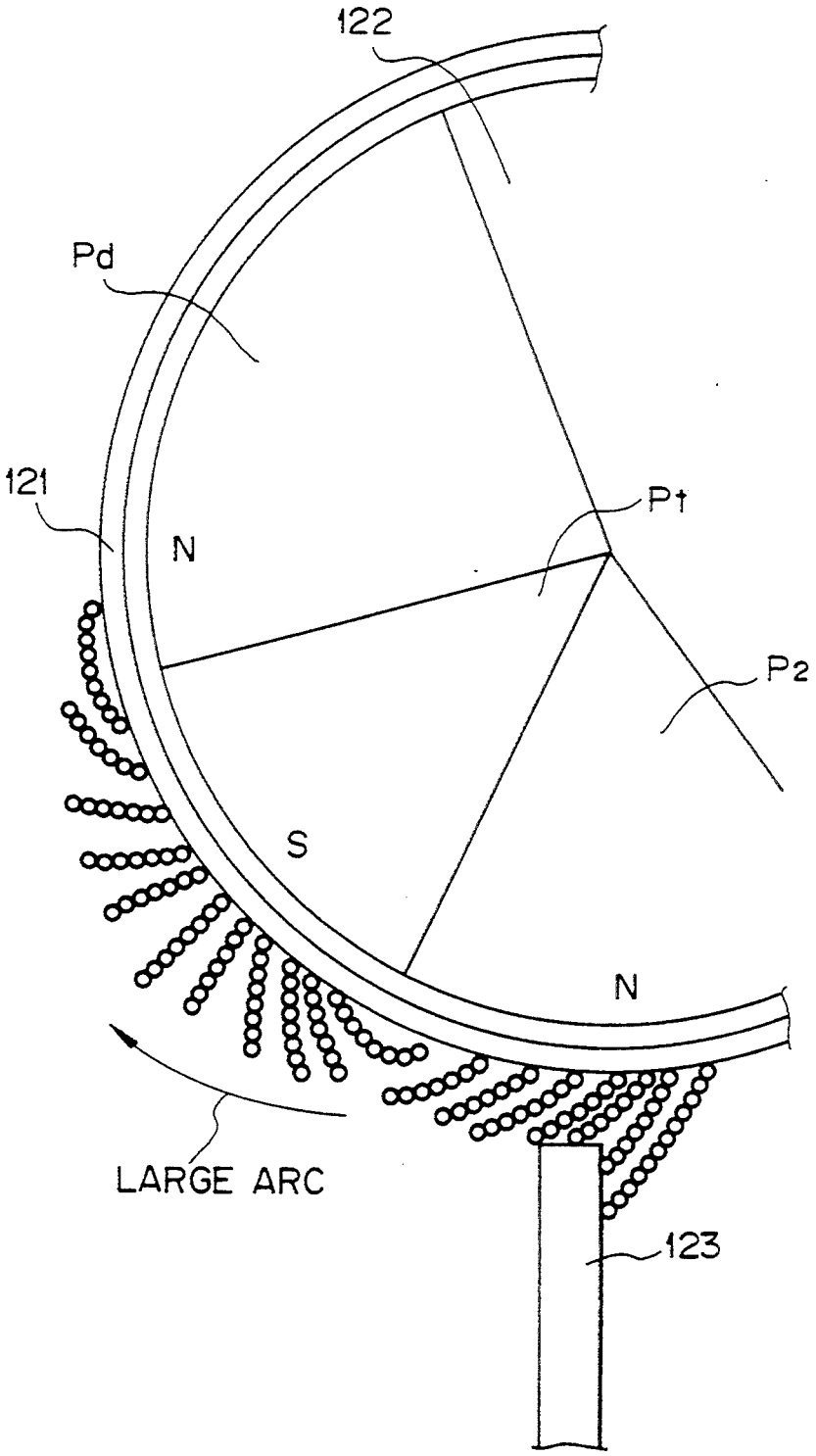
FIG. 24 is an operation explanatory view (Part 1) of the above embodiment of this invention.
Figure 25A:
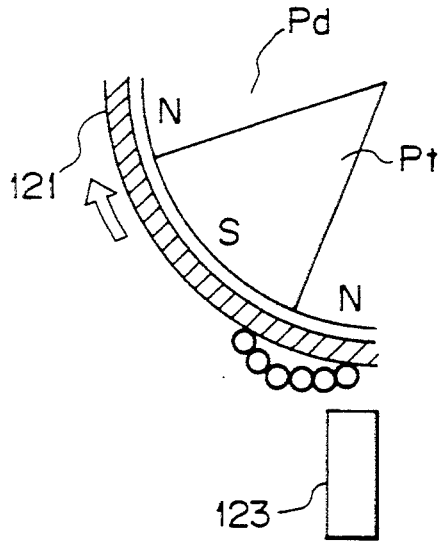
FIGS. 25(*a*) to 25(*d*) are operation explanatory views (Part 2) of the above embodiment of this invention.
Figure 25B:
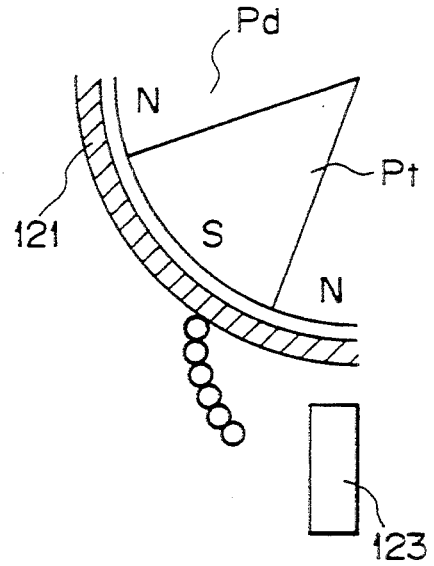
Figure 25C:
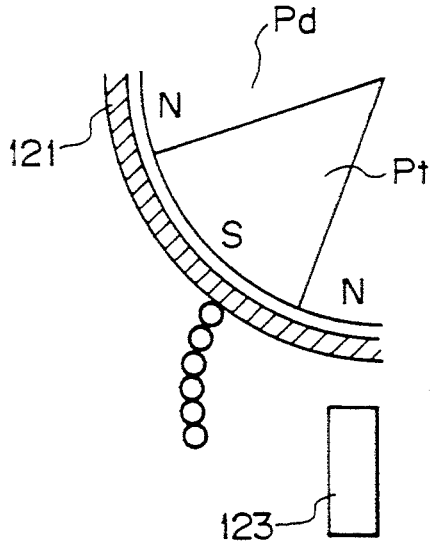
Figure 25D:
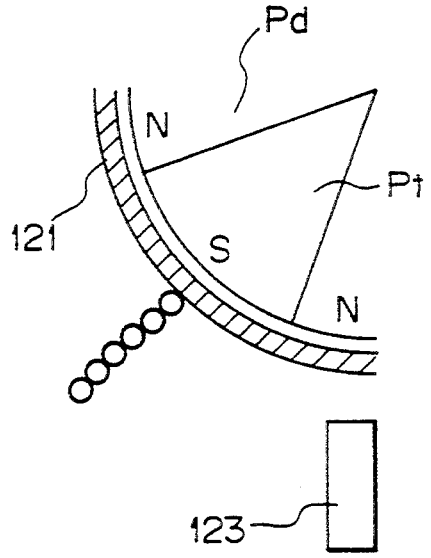

FIG. 22 is a block diagram of one preferred embodiment, FIG. 23 is a view showing a magnetic flux density distribution in this embodiment and FIGS. 24 and 25(*a*-)-25(*b*) are operation explanatory views (Part 1) and (Part 2) of this embodiment.

The magnet 122 of the developing roller 120 in FIG. 22 is a ferrite for isotropic permanent magnet, which is provided to the outer circumference of a metallic shaft, to which five magnetic poles P1 through P3, Pt and Pd are installed, and the space between the magnetic pole P3 and the magnetic pole P1 has not been magnetized.

The sleeve 121 of the developing roller 120 has a diameter of 30 mm with its number of revolutions being 250 rpm, a doctor blade 123 made of a metallic plate is located with a certain interval provided against the sleeve 121, and a scraper blade 124 is also made of a metallic plate.

The developer is a carrier wherein a resin is coated onto an iron oxide sintered metal of 60 micron grain size, the carrier adhesion is more likely to happen as compared with the carrier of 100 micron grain size which is frequently used. The toner has its grain size of 10 micron of polyester resin.

The magnetic flux density distribution (magnetized pattern) of this developing roller 120 is as illustrated in FIG. 23. Namely, the magnetic flux density is determined a perpendicular direction against the sleeve surface on the sleeve 121.

Here, the closest point between the developing roller 120 and the photosensitive drum 131 has an angle of 90° against the crest point of doctor blade 123.

A magnetic flux density flat area is provided in the vicinity of the doctor blade 123 so as to stabilize the developer restriction volume.

The width (or angles) of the transfer magnetic poles P2 and P3 as well as of the development magnetic pole Pd are 53°, 42° and 94° respectively as they have conventionally been so, while the magnetic pole Pt between the doctor blade 123 and the development magnetic pole Pd has a width (angle) of 52° with its maximum magnetic flux density being 900G (Gauss), and the half value width (angle) of magnetic flux density (the width or angle in the area where a radial component of the magnetic flux density is 450G or more) is 30° which has been increased by 5°.

The width of transfer magnetic pole P1 has been narrowed by 5° to 56°, thereby moving the development magnetic pole Pd by 5° clockwise.

FIG. 24 and FIGS. 25(*a*)-25(*d*) explain the operation when the half value width of the transfer magnetic pole Pt has been widened in this way.

The developer is cut out by the doctor blade 123 arranged opposite to the transfer magnetic pole P2 as shown in FIG. 24, if the crest the magnetic brush on the sleeve 121 has been coupled to both the magnetic poles Pt and Pd and laid down as shown in FIG. 25(*a*), and moreover the sleeve 121 is turned as shown by an arrow. The developer gradually rises to be an erected state against the sleeve 121 in accordance with the magnetic force lines of the transfer magnetic pole Pt and the transfer magnetic pole P2 as illustrated in FIGS. 25(*b*) and 25(*c*), then keeps on falling down toward the development magnetic pole Pd by the magnetic force lines of the transfer magnetic pole Pt and the development magnetic pole Pd as shown in FIG. 25(*d*).

Because the magnetic pole width of the transfer magnetic pole Pt has been widened in this embodiment, the arc being depicted by the crest of magnetic brush becomes greater with its speed becoming lower, and the centrifugal force at the tip of the crest of magnetic brush becomes smaller.

Consequently, the developer at the tip of the crest of magnetic brush can be prevented from separating and flying away from its tip, and thus being able to prevent the splash of the carrier adhered to the toner.

Furthermore, because the magnetic pole width Pt of the transfer magnetic pole Pt has been widened and the magnetic pole width of the development magnetic pole Pd has been left unchanged, the number of magnetic force lines to the transfer magnetic pole Pt from the development magnetic pole Pd has been increased, thus being able to increase the magnetic suction force of the carrier at the position opposite to the photosensitive drum 131 and to prevent the adhesion of the carrier to the photosensitive drum 131.

The half value width of magnetic flux density of the transfer magnetic pole Pt will now be explained.

Figure 26:
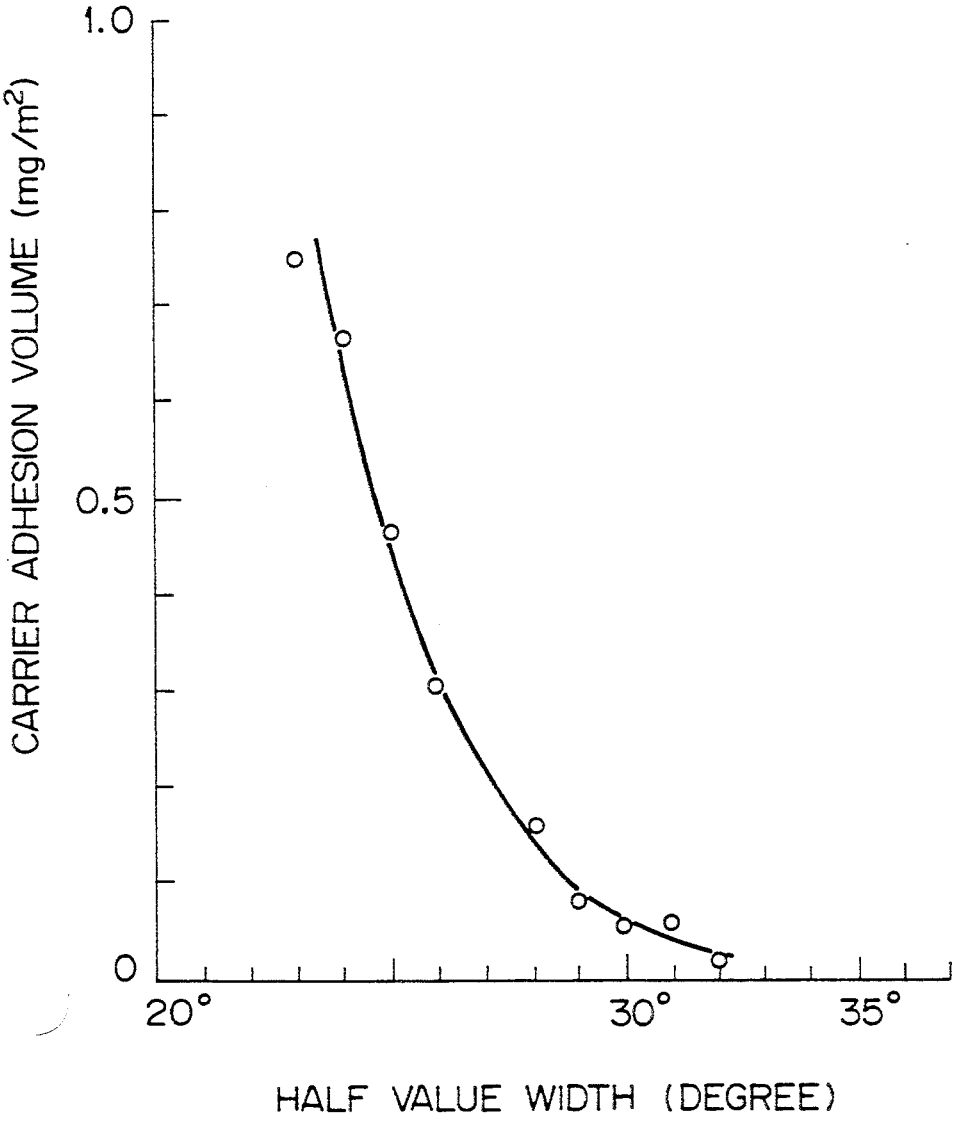
FIG. 26 is a relationship diagram between the half value width and the carrier adhesion volume in the above embodiment.
Figure 28:
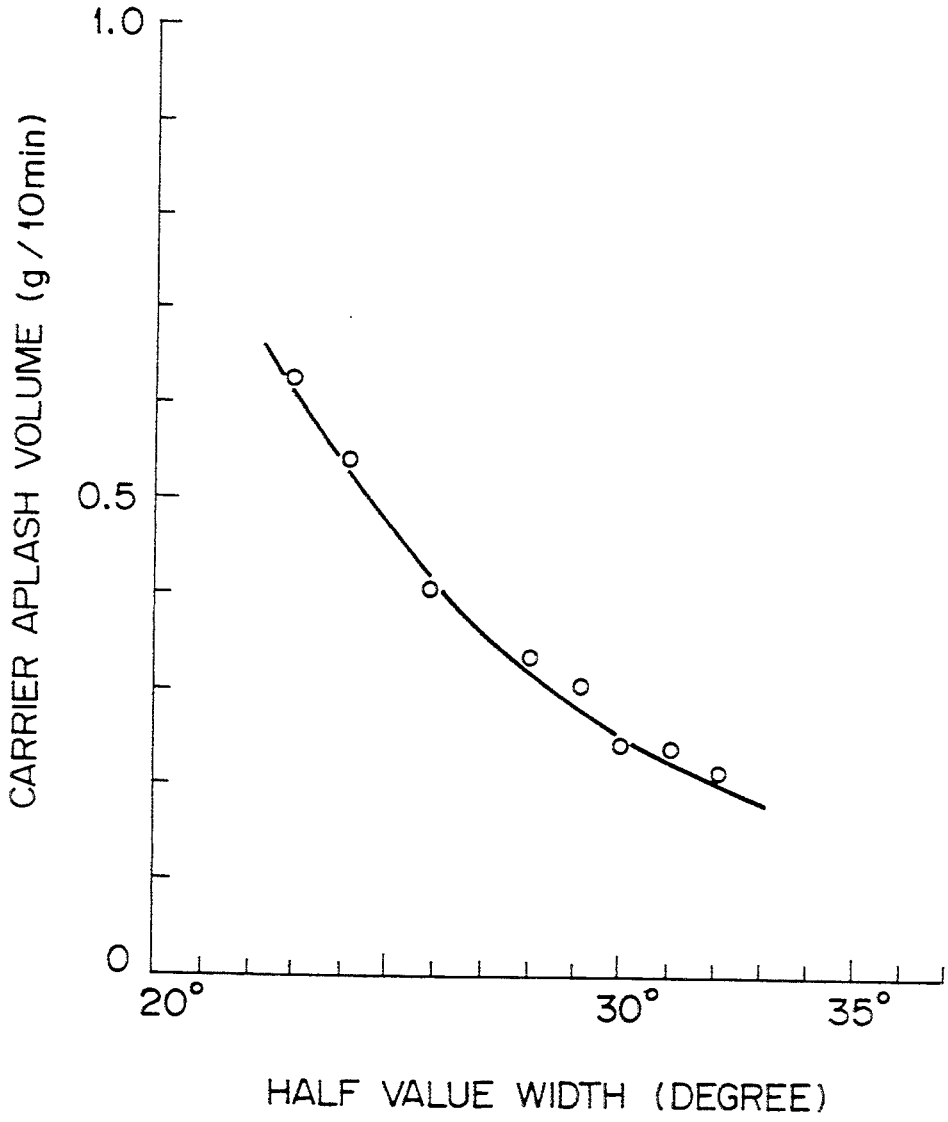
FIG. 28 is a relationship diagram between the half value width and the carrier splash volume in the above embodiment.

FIG. 26 shows a relationship view between the half value width and the carrier adhesion volume in this embodiment, FIG. 27 is an explanatory view (Part 1) of the half value width and the void location of one preferred embodiment of this present invention, FIG. 28 shows a relationship view between the half value width and the carrier splash volume in this embodiment, and FIG. 29 is an explanatory view of the half value width and the void location in this embodiment.

The magnets 122 with their half value width of transfer magnetic pole Pt being, 23°, 24°, 25°, 26°, 28°, 29°, 30°, 31° and 32° were prepared and set to the developing roller 120 respectively, and the carrier adhesion volume to the photosensitive drum 31 was measured using an electronic printing apparatus.

The carrier adhesion volume was measured using the carrier adhesion volume measuring method described in the Specification of Japanese Patent Application No. 3-112,894 filed in 1991.

This method is for collecting the carrier adhered to the photosensitive drum 131 and measuring its weight after having driven the developing device to develop and transcribe an image on the photosensitive drum 131.

FIG. 26 shows the collected carrier adhered to the drum which has been converted into the weight (mg) per unit area (square meter) of the photosensitive drum 131.

It can be shown from FIG. 26 that the carrier adhesion volume is decreased more if the half value width of the transfer magnetic pole Pt is wider.

Next, a film was laid down below the developing device 102 in the developing unit as shown in FIG. 22 so that no splashed carrier may fall down on the printing paper, then the eight magnets 122 (their half value width of transfer magnet pole Pt being 23°, 24°, 26°, 28°, 29°, 30°, 31° and 32°) were prepared and set to the developing roller 120, and the oblique line patterns at the interval of about 1 mm were printed on whole the paper area to investigate the presence of the void locations of the transcribed paper. FIG. 27 shows the result.

Here, ten sheets of A4 size paper were printed for every half value width for investigating the quantity of void locations of ten sheets of printed paper.

As shown in FIG. 27, it can be shown here too that the number of void locations can be lessened as the half value width of the transfer magnetic pole Pt becomes wider, and only three void locations are found out per ten sheets of paper in case of the half value width being 26° and it was discovered that there was virtually no problem in case of the half value width greater than 26°.

At the next step, carrier splash volume was measured.

This method was to lay a film below the developing device 102 shown in FIG. 22, and to measure the weight of the carrier on the film.

The magnets with their half value widths of the transfer magnetic pole Pt being 23°, 24°, 26°, 28°, 29°, 30°, 31° and 32° were prepared and set to the developing roller 120 of FIG. 22 respectively, and the developing device was operated for twenty minutes in the transfer magnetic pole Pt of half value width respectively for conducting the experiment. FIG. 28 shows the result.

As shown in FIG. 28, it can be shown that the carrier splash volume during the operation for ten minutes is decreased as wider becomes the half value width.

Next, in the unit developing shown in FIG. 22, the foregoing film was removed, the similar magnet 122 was set to the developing roller 120, and ten sheets of A4 size paper were printed against each of half value widths for visually confirming the number of void locations and the presence of carrier below the developing device 102 inside the unit at that time.

Its result is shown in FIG. 29, and the number of void locations is greater than that shown in FIG. 27 because the adhesion volume of the aforesaid carrier to the photosensitive drum 131 is also included.

From FIG. 29, it can be seen that the number of void locations per ten sheets of A4 size paper proved to be eighteen places with more or less carrier existing inside the unit, but if the half value width has reached 28°, the number of void locations per ten sheets of A4 size paper was lessened to three places, posing no practical use problem and revealing no carrier inside the unit.

From the above, it could be found out that the carrier adhesion and the carrier splash can be decreased and the printing without any void locations can be obtained if the half value width of the magnetic flux density of transfer magnetic pole Pt should be set to 28° or higher.

Furthermore, the upper limit of half value width of the magnetic flux density of transfer magnetic pole Pt is restricted and is supposed preferably to be around 35° because the development magnetic pole Pd is moved in clockwise direction and the magnetic brush can no longer be favorably formed at the position opposite to the photosensitive drum 131 if the half value width of the magnetic flux density of transfer magnetic pole Pt is widened too much.

The reason why the magnetic pole width has been stipulated by the half value width is for removing the influence of the portion of the magnetic pole width in the state where the crest of magnetic brush is laid down.

In other words, the magnetic pole width has been specified by the half value width, because the angle becoming a problem is from the rising start of the crest of magnetic brush to its lying down, although the crest of magnetic brush is laid down in the boundary of magnetic poles (the location changing over to S from N).

As a result of changing the number of revolutions of the sleeve 121 and conducting the similar experiment, it was confirmed that no practical use problem existed in case of the number of revolutions being lower than 300 rpm.

The flat portion (FIG. 23) of magnetic flux density of the sleeve 121 at the position of doctor blade 123 can be effectively used to uniform the restriction developer volume not depending on the positional accuracy of doctor blade 123 by making the magnetic flux density on the sleeve 121 at the installation position of doctor blade 123 to be flat as shown in Japanese Patent Application No. 3-220,221 (filed on Aug. 30, 1991), "Magnetic Brush Developing Device". The magnetic flux density formed by the magnetic brush on the sleeve is thus constant at that area as shown in FIG. 24.

Thereby the restriction developer volume can be made uniform, and the scattering in the restriction developer volume at every developing device can be prevented for enhancing the image quality even if the mounting position margin of doctor blade 123 can be made larger to simplify the assembly of the unit.

The method for providing this flat portion can be realized as shown in the magnetization pattern in FIG. 23 by intensifying the magnetization strength of the transfer magnetic pole Pt more than the magnetization strength of transfer magnetic pole P2, as also shown in the specification of the above Patent Application No. 3-220,221.

The flat portion providing method can also be realized by building up the transfer magnetic pole P2 with two magnetic poles and by weakening the magnetization strength of one of the magnetic pole on the side of the transfer magnetic pole Pt.

When the crest of magnetic brush is cut off in this flat portion, the crest of magnetic brush is unlikely to rise because of its poor magnetization. Therefore, the turning torque of sleeve 121 can be decreased, because the pressure against the doctor blade 123 can be reduced.

As mentioned above, the splash of carrier and the adhesion of carrier can be prevented by widening the half value width of the magnetic flux density of transfer magnetic pole Pt between the developing magnetic pole Pd and the blade 123 in this way, and the void location becomes no problem in practical use even if the printing is carried out at a high resolution.

In addition to the foregoing embodiments, the present invention is available in the following variations.

(1) The carrier of developer in the form of 60 microns has been explained, but the carriers of 100 microns or the other can be employed in the similar manner.

(2) The printing mechanism 103 in the form of the electronic photograph mechanism has been explained in the aforesaid embodiments, but the other printing mechanisms (for example, an electro-static recording mechanism and so forth) can also be used for developing.

(3) The printing unit in the form of a printer has been explained, but the other types of the printing units such as a copier and a facsimile may be acceptable.

As explained above, the following effects can be offered according to the present invention.

(1) Because the half value width of magnetic flux density on the surface of sleeve 121 of the transfer magnetic pole Pt has been widened to the value where the developer at the tip of magnetic brush may not be flown out by the centrifugal force of arc being depicted by the crest of magnetic brush, and the arc being drawn by the magnetic brush has been enlarged, the speed of magnetic brush tip falls down resulting in the decreased centrifugal force, so the developer at the tip of magnetic brush can be prevented from flying out.

(2) The magnetic lines to the transfer magnet pole Pt from the development magnetic pole Pd has been increased by widening the half value width of magnetic flux density on the surface of sleeve 121 of the transfer magnetic pole Pt, and the magnetic suction force of developer has been increased, and the development can be made in a favorable manner.

This invention has been explained with reference to some preferred embodiments, but a variety of modifications are possible within the scope or spirit of the present invention, which should not be excluded from the scope of this invention.

We claim:

1. A magnetic brush developing apparatus comprising:

a development container for containing a developer;

a magnet stationarily located in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict an amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve.

2. A magnetic brush developing apparatus as claimed in claim 1, wherein said rotational sleeve rotates in such a manner that said sleeve moves upward in a developing region opposite to said image carrying body.

3. A magnetic brush developing apparatus comprising:

a development container for containing a developer;

a magnet stationarily located in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict an amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve, wherein an angle between a crest cutting point of said developer restriction member and a closest point of said image carrying body with said rotational sleeve is approximately 90° and said half value width of magnetic flux density of said developer carrying magnetic pole is more than 28°.

4. A magnetic brush developing apparatus as claimed in claim 1, wherein said developer is a two-component developer.

5. A magnetic brush developing apparatus comprising:

a development container for containing a developer;

a magnet fixed in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict the amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve;

a uniform magnetic flux density section, where a radial component of the magnetic flux density is substantially uniform, being formed on a periphery of said rotational sleeve; and said developer restriction member located at a position facing said rotational sleeve arranged opposite to said uniform magnetic flux density section.

6. A magnetic brush developing apparatus as claimed in claim 5, wherein said rotational sleeve rotates in such a manner that said sleeve moves upward in a developing region opposite to said image carrying body.

7. A magnetic brush developing apparatus comprising:

a development container for containing a developer;

a magnet fixed in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict the amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value with of said magnetic flux density of said developer transfer magnetic pole being determined such that said developer at a tip of said magnetic brush is prevented from separating and flying away due to a centrifugal force of an arc caused by rotation of said rotational sleeve;

a uniform magnetic flux density section, where a radial component of the magnetic flux density is substantially uniform, being formed on a periphery of said rotational sleeve; and said developer restriction member located at a position facing said rotational sleeve arranged opposite to said uniform magnetic flux density section, wherein said uniform magnetic flux density section is provided on both sides of a developer restriction member facing point therebetween so as to extend by an angle of at least 10 degrees each in terms of a rotational angle of said rotational sleeve.

8. A magnetic brush developing apparatus comprising:

a development container for containing a developer;

a magnet fixed in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict the amount of the developer carried by said rotational sleeve.;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve:

a uniform magnetic flux density section, where a radial component of the magnetic flux density is substantially uniform, being formed on a periphery of said rotational sleeve; and said developer restriction member located at a position facing said rotational sleeve arranged opposite to said uniform magnetic flux density section, wherein said uniform magnetic flux density section has a vertical magnetic flux density lying within the range of ±10% with respect to a preset value for a developer restriction member facing point.

9. A magnetic brush developing apparatus comprising:

a development container for containing a developer;

a magnet fixed in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict the amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve;

a uniform magnetic flux density section, where a radial component of the magnetic flux density is substantially uniform, being formed on a periphery of said rotational sleeve; and said developer restriction member located at a position facing said rotational sleeve arranged opposite to said uniform magnetic flux density section, wherein said uniform magnetic flux density section is provided on both sides of a developer restriction member facing point therebetween so as to extend by an angle of at least 3 degrees in terms of a rotation angle of said rotational sleeve, and said uniform magnetic flux density sections has a vertical magnetic flux density lying within the range of ±20% with respect to a preset value for said developer restriction member facing point.

10. A magnetic brush developing apparatus comprising:

a development container for containing a developer;

a magnet fixed in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict the amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve;

a uniform magnetic flux density section, where a radial component of the magnetic flux density is substantially uniform, being formed on a periphery of said rotational sleeve; and said developer restriction member located at a position facing said rotational sleeve arranged opposite to said uniform magnetic flux density section, wherein said uniform magnetic flux density section is provided on both sides of a developer restriction member facing point therebetween so as to extend by an angle of at least 3 degrees in terms of a rotation angle of said rotational sleeve, and said uniform magnetic flux density sections has a vertical magnetic flux density lying within the range of ±10% with respect to a preset value for said developer restriction member facing point.

11. A magnetic brush developing apparatus comprising:

a development container for containing a developer;

a magnet fixed in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict the amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve;

a uniform magnetic flux density section, where a radial component of the magnetic flux density is substantially uniform, being formed on a periphery of said rotational sleeve; and said developer restriction member located at a position facing said rotational sleeve arranged opposite to said uniform magnetic flux density section, wherein said uniform magnetic flux density section is provided on both sides of a developer restriction member facing point therebetween so as to extend by an angle of at least 10 degree in terms of a rotation angle of said rotational sleeve, and said uniform magnetic flux density sections has a vertical magnetic flux density lying within the range of ±20% with respect to a preset value for said developer restriction member facing point.

12. A magnetic brush developing apparatus comprising:

a development container for containing a developer;

a magnet fixed in said development container and having magnetic poles radially provided on a plurality of points thereof;

a rotational sleeve arranged so as to cover an outer circumference of said magnet and rotatably driven to carry the developer in said development container to an image carrying body;

a developer restriction member arranged opposite to said rotational sleeve to restrict the amount of the developer carried by said rotational sleeve;

two of said magnetic poles being a developing magnetic pole facing opposite to said image carrying body and a developer transfer magnetic pole located between said developing magnetic pole and said developer restriction member;

a magnetic brush of said developer formed on said rotational sleeve by said developer transfer magnetic pole having a magnetic flux density, a half value width of said magnetic flux density of said developer transfer magnetic pole being determined such that said developer at a tip of said magnetic brush is prevented from separating and flying away due to a centrifugal force of an arc caused by rotation of said rotational sleeve;

a uniform magnetic flux density section, where a radial component of the magnetic flux density is substantially uniform, being formed on a periphery of said rotational sleeve; and said developer restriction member located at a position facing said rotational sleeve arranged opposite to said uniform magnetic flux density section, wherein said uniform magnetic flux density section is provided on both sides of a developer restriction member facing point therebetween so as to extend by an angle of at least 5 degree in terms of a rotation angle of said rotational sleeve, and said uniform magnetic flux density sections has a vertical magnetic flux density lying within the range of ±15% with respect to a preset value for said developer restriction member facing point.

* * * * *